US012281653B2

(12) United States Patent
Yoo et al.

(10) Patent No.: US 12,281,653 B2
(45) Date of Patent: Apr. 22, 2025

(54) SCROLL COMPRESSOR

(71) Applicant: LG ELECTRONICS INC., Seoul (KR)

(72) Inventors: Byungkil Yoo, Seoul (KR); Jungsun Choi, Seoul (KR); Seheon Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/691,383

(22) PCT Filed: Jul. 29, 2022

(86) PCT No.: PCT/KR2022/011229

§ 371 (c)(1),
(2) Date: Mar. 12, 2024

(87) PCT Pub. No.: WO2023/038293

PCT Pub. Date: Mar. 16, 2023

(65) Prior Publication Data

US 2024/0376895 A1 Nov. 14, 2024

(30) Foreign Application Priority Data

Sep. 13, 2021 (KR) ..... 10-2021-0121968

(51) Int. Cl.

| | |
|---|---|
| ***F04C 18/00*** | (2006.01) |
| ***F04C 18/02*** | (2006.01) |
| ***F04C 23/00*** | (2006.01) |
| ***F04C 29/00*** | (2006.01) |
| ***F04C 29/02*** | (2006.01) |

(52) U.S. Cl.

CPC ..... *F04C 29/0057* (2013.01); *F04C 18/0215* (2013.01); *F04C 29/0071* (2013.01); (Continued)

(58) Field of Classification Search

CPC ..... F04C 18/0215; F04C 23/0108; F04C 29/0057; F04C 29/0071; F04C 29/023; (Continued)

(56) References Cited

U.S. PATENT DOCUMENTS

2017/0067466 A1* 3/2017 Oh ..... F01C 17/066
2017/0234313 A1 8/2017 Fullenkamp et al.
(Continued)

FOREIGN PATENT DOCUMENTS

CN 210484061 U 5/2020
EP 3 199 753 A1 8/2017
(Continued)

OTHER PUBLICATIONS

JP02-227580A—Oikawa et al.—Oldham Joint of Scroll Compressor Etc.—Sep. 10, 1990—the English Machine Translation. (Year: 1990).*

(Continued)

*Primary Examiner* — Theresa Trieu
(74) *Attorney, Agent, or Firm* — Birch, Stewart, Kolasch & Birch, LLP

(57) ABSTRACT

A scroll compressor includes a plurality of fixing protrusions that are provided spaced apart from each other in a key that constitutes an Oldham ring, and an orbiting scroll, to which the key is coupled, or a ring body of the Oldham ring may be provided with a plurality of fixing grooves which are spaced part from each other and into which the plurality of fixing protrusions are respectively inserted and fixed.

14 Claims, 13 Drawing Sheets

(52) U.S. Cl.
CPC ..... *F04C 29/023* (2013.01); *F04C 23/008* (2013.01); *F04C 2240/802* (2013.01)

(58) Field of Classification Search
CPC ..... F04C 2240/70; F04C 2240/801; F04C 2240/802; F04C 2270/16; F04C 23/008; F01C 17/066
See application file for complete search history.

(56) References Cited

U.S. PATENT DOCUMENTS

| | | | | |
|---|---|---|---|---|
| 2019/0345940 | A1 | 11/2019 | Jang et al. | |
| 2019/0345941 | A1* | 11/2019 | Yoo | F01C 17/066 |

FOREIGN PATENT DOCUMENTS

| | | | | |
|---|---|---|---|---|
| JP | 2-227580 | A | 9/1990 | |
| JP | 05223068 | A * | 8/1993 | F01C 17/066 |
| JP | 2017-133466 | A | 8/2017 | |
| KR | 1999-0050820 | A | 7/1999 | |
| KR | 10-2014-0085659 | A | 7/2014 | |
| KR | 10-2019-0129373 | A | 11/2019 | |
| KR | 10-2019-0139058 | A | 12/2019 | |
| KR | 10-2081341 | B1 | 2/2020 | |
| KR | 10-2021-0101470 | A | 8/2021 | |

OTHER PUBLICATIONS

JP05-223068—Kuribayashi et al.—Scroll Type compressor—Aug. 31, 1993—the English Machine Translation (Year: 1993 ).*
KR102081341B1—Yoo et al.—Scroll Compressor—Feb. 25, 2020—the English Machine Translation. (Year: 2020).*
KR 20190139058A—Jang et al.—Scroll Compressor—Dec. 17, 2019—the English Machine Translation. (Year: 2019).*
International Search Report, issued in PCT/KR2022/011229, PCT/ISA/210. dated Nov. 8, 2022.

* cited by examiner

SCROLL COMPRESSOR

CROSS-REFERENCE TO RELATED APPLICATIONS

This application is the National Stage filing under 35 U.S.C. 371 of International Application No. PCT/KR2022/011229, filed on Jul. 29, 2022, which claims the benefit of earlier filing date and right of priority to Korean Application No. 10-2021-0121968, filed in the Republic of Korea on Sep. 13, 2021, the contents of which are all hereby incorporated by reference herein in their entirety.

TECHNICAL FIELD

The present disclosure relates to an Oldham ring and a scroll compressor including the same.

BACKGROUND ART

A scroll compressor is a compressor in which one scroll or two scrolls facing each other form a compression chamber, which moves continuously, while performing an orbiting motion. The scroll compressor may include an anti-vibration member that restricts one scroll (e.g., orbiting scroll), which receives rotational force of a drive motor, from rotating relative to another scroll (e.g., fixed scroll) facing the one scroll or a fixed frame.

An Oldham ring or pin and ring is mainly known as such anti-rotation member. The Oldham ring is advantageous in terms of assembling property compared to the pin and ring. Recently, a technology has been introduced to secure necessary rigidity while reducing weight by making a ring body and a key of the Oldham ring using different materials.

Patent Document 1 (US Patent Publication No. 2017/0234313 A1) discloses a technology in which a ring body and a key are made of different materials, and the key is press-fitted or bonded to the protrusion of the ring body to reduce the weight of the Oldham ring and increase wear resistance. In Patent Document 1, there is a possibility that mechanical reliability is lowered at a joint portion between the ring body and the key or the key is separated from the ring body during operation of the compressor due to a difference in thermal strain between the ring body and the key.

On the other hand, a technology is also introduced in which the Oldham ring is formed as a single part and an anti-wear member is interposed between the key of the Oldham ring and the key groove of a scroll (or frame).

Patent Document 2 (Japanese Patent Publication No. 2017-133466) discloses a technology for suppressing wear between a key groove and a key by providing an anti-wear member between the key groove and the key. In Patent Document 2, the anti-wear member may be separated or a press-fitting band may be released during operation of the compressor due to a difference in thermal expansion rate between the anti-wear member and a scroll (or fixed frame), thereby causing vibration noise.

DISCLOSURE OF INVENTION

Technical Problem

One aspect of the present disclosure is to provide a scroll compressor that is capable of improving motor efficiency by reducing the weight of an Oldham ring as an anti-rotation mechanism.

Another aspect of the present disclosure is to provide a scroll compressor that is capable of reducing the weight of an Oldham ring and friction loss between an orbiting scroll and the Oldham ring by making a portion of the Oldham ring with the same material as the orbiting scroll.

Still another aspect of the present disclosure is to provide a scroll compressor that is capable of suppressing a key constituting an Oldham ring from being separated due to a change in ambient temperature during operation by increasing coupling force between the key and a member to which the key is fixed.

Yet another aspect of the present disclosure is to provide a scroll compressor that is capable of increasing reliability of an Oldham ring by securing high support strength for a key constituting the Oldham ring and a member to which the key is fixed.

Yet another aspect of the present disclosure is to provide a scroll compressor that is capable of reducing friction loss while making an Oldham ring with a light material.

Yet another aspect of the present disclosure is to provide a scroll compressor that is capable of suppressing separation of an anti-wear member even if the anti-wear member is inserted into an orbiting scroll or a main frame, to which a key of an Oldham ring is slidably coupled.

Yet another aspect of the present disclosure is to provide a scroll compressor that is capable of effectively suppressing separation of an anti-wear member while simply inserting the anti-wear member into an orbiting scroll or a main frame.

Solution to Problem

In order to achieve those aspects of the present disclosure, there is provided a scroll compressor that includes a plurality of scrolls and an Oldham ring that restricts rotational movement of at least one scroll of the plurality of scrolls. An orbiting scroll, as at least one scroll of the plurality of scrolls engaged with each other, may be coupled to a rotational shaft to perform an orbiting motion. The Oldham ring may be slidably coupled to the orbiting scroll to induce the orbiting motion of the orbiting scroll. A key groove may be formed in one of the orbiting scroll and the Oldham ring, and a key may be disposed on another one to be slidably inserted into the key groove. The key may have a plurality of fixing protrusions spaced apart from each other, and the orbiting scroll or the Oldham ring may include a plurality of fixing grooves which are spaced apart from each other and in which the plurality of fixing protrusions are fixedly inserted. Through this, the inside of the key may be formed in a hollow shape, reducing the weight of the key. This can reduce the weight of the Oldham ring and thus improve motor efficiency. At the same time, since the key is press-fitted to a plurality of press-fit surfaces, the key can be prevented from being separated from the orbiting scroll or a ring body due to a difference in thermal strain, thereby enhancing reliability.

For example, a key groove may be formed in the Oldham ring, and a plurality of fixing grooves may be formed in one side surface of the orbiting scroll facing the key groove. The plurality of fixing grooves may be spaced apart from each other in a circumferential or a radial direction and each of the plurality of fixing grooves may be in close contact with at least one of an outer or inner surface of the fixed protrusion. Through this, the key can be prevented from being separated from the orbiting scroll or Oldham ring even if the surrounding temperature conditions of the orbiting scroll or Oldham ring change during operation, thereby enhancing reliability.

Specifically, the plurality of the fixing protrusions and the plurality of fixing grooves may be disposed as pairs and spaced apart from each other along at least one of a circumferential direction and a radial direction. This can suppress the separation of the key even during thermal expansion and thermal contraction, thereby enhancing reliability.

As another example, the fixing protrusions may extend in an axial direction from both circumferential side surfaces of the key. Through this, the weight of the key can be reduced while smoothly performing a function of restricting the rotation of the orbiting scroll, and at the same time, both radial ends of the key can be open to increase an oil supply effect on the key and key groove.

As another example, the plurality of fixing protrusions may be connected into a ring shape. The plurality of fixing grooves may be connected into a ring shape. This can reduce the weight of the key, effectively prevent the separation of the key due to thermal deformation, and secure the cross-sectional area of the key to increase support strength.

As another example, the plurality of fixing protrusions may be spaced apart from each other to be in parallel. The plurality of fixing grooves may be spaced apart from each other to be in parallel. With the configuration, the key can be fixed uniformly along its longitudinal direction, to be more effectively prevented from being separated due to the thermal deformation.

Specifically, the key may include circumferential side surfaces and radial side surfaces. The circumferential side surfaces may be disposed at a preset interval on both sides in a circumferential direction. The radial side surfaces may be disposed at a preset interval on both sides in a radial direction and connect both the circumferential surfaces to each other. A hollow portion may be defined between inner surfaces of both the circumferential side surfaces and inner surfaces of both the radial side surfaces, and one end portion of each of the circumferential side surfaces and one end portion of each of the radial side surfaces may form the fixing protrusions. This can reduce the weight of the key, effectively prevent the separation of the key due to thermal deformation, and secure the cross-sectional area of the key to increase support strength.

In addition, the key may further include an axial side surface connecting both the circumferential side surfaces and both the radial side surfaces. This can secure rigidities of the circumferential and radial side surfaces, thereby enhancing reliability of the key.

Furthermore, the axial side surface may have a through hole formed therethrough to have a cross-sectional area smaller than a cross-sectional area of the hollow portion. This can prevent refrigerant from being filled in the key and allow a predetermined amount of oil to be stored in the key, thereby reducing friction loss during restart of the compressor.

As another example, the key may include circumferential side surfaces and an axial side surface. The circumferential side surfaces may be disposed at a preset interval on both sides in a circumferential direction. The axial side surface may connect both the circumferential side surfaces. A hollow portion may be defined between inner surfaces of both the circumferential side surfaces and an inner surface of the axial side surface, and one end portion of each of the circumferential side surfaces may form the fixing protrusion. This can secure support strength of the circumferential side surfaces substantially constituting the key of the Oldham ring even without the radial side surfaces.

As another example, the key may include circumferential side surfaces. The circumferential side surfaces may be disposed at a preset interval on both sides in a circumferential direction. The fixing protrusions may extend from both the circumferential side surfaces toward the fixing grooves, respectively. The circumferential side surfaces and the fixing protrusions may be formed on the same axis. This can secure the cross-sectional area of the key, thereby increasing support strength.

As another example, the key may include circumferential side surfaces and a hollow portion. The circumferential side surfaces may be disposed at a preset interval on both sides in a circumferential direction. The hollow portion may be defined between both the circumferential side surfaces. An oil supply groove may be formed in an outer surface of at least one of both the circumferential side surfaces or an oil supply hole may be formed to penetrate between the outer surface and an inner surface of the at least one circumferential side surface. With this configuration, a certain amount of oil can be smoothly supplied between the key and the key groove, reducing friction loss.

As another example, the key may include circumferential side surfaces and a hollow portion. The circumferential side surfaces may be disposed at a preset interval on both sides in a circumferential direction. The hollow portion may be defined between both the circumferential side surfaces. Oil supply grooves may be formed in circumferential inner surfaces of the key groove facing the circumferential side surfaces. With this configuration, a certain amount of oil can be smoothly supplied between the key and the key groove, reducing friction loss.

Here, the Oldham ring may be made of the same material as the orbiting scroll. This can reduce the weight of the Oldham ring, thereby enhancing motor efficiency.

Furthermore, the scroll compressor may further include a frame made of a different material from the orbiting scroll and disposed to be slidable relative to the Oldham ring. The key groove may be formed in the frame. The Oldham ring may include a ring body formed in an annular shape, and a key integrally extending from the ring body and inserted into the key groove of the frame. With the configuration, the ring body and at least one key of the Oldham ring can be made of a lightweight material, lowering the weight of the Oldham ring and enhancing motor efficiency.

In order to achieve those aspects of the present disclosure, there is provided a scroll compressor that includes a plurality of scrolls and an Oldham ring that restricts rotational movement of at least one scroll of the plurality of scrolls. An orbiting scroll, as at least one scroll of the plurality of scrolls engaged with each other, may be coupled to a rotational shaft to perform an orbiting motion. The Oldham ring may be slidably coupled to the orbiting scroll to induce the orbiting motion of the orbiting scroll. A key groove may be formed in one of the orbiting scroll and the Oldham ring. The Oldham ring may include a ring body formed in an annular shape, and a key extending from the ring body and inserted into the key groove. A liner may be inserted into the key groove. A liner fixing groove may be formed in one circumferential side or each of both circumferential sides of the key groove to be spaced apart from the key groove, such that at least a portion thereof overlaps the key groove in the circumferential direction. A liner fixing jaw may be formed between the key groove and the liner fixing groove. Through this, the weight of the Oldham ring can be further reduced by making the Oldham ring using a single material, while the separation of the liner disposed between the Oldham ring and the orbiting scroll can be prevented to enhance reliability.

For example, the liner may include a liner body portion, a liner extension portion, and a liner fixing portion. The liner body portion may be inserted into the key groove so that the key can be slidably inserted. The liner extension portion may extend from the liner body portion in the circumferential direction. The liner fixing portion may extend axially from the liner extension portion and may be inserted into the liner fixing groove. The liner body portion and the liner fixing portion may overlap a side surface of the liner fixing jaw in the circumferential direction. This can effectively suppress the separation of the liner due to a difference of thermal strain between the orbiting scroll and the liner.

A liner insertion groove may be recessed by a preset depth axially into an axial cross-section of the liner fixing groove, such that the liner extension portion is inserted. Accordingly, the liner can be hidden in the orbiting scroll and collision with neighboring members can be prevented during the orbiting movement of the orbiting scroll, thereby stabilizing the behavior of the orbiting scroll.

An oil supply groove may further be formed in an inner surface of the liner body portion to extend in a radial direction. Accordingly, a certain amount of oil can be supplied between the liner and the key, thereby preventing friction loss and wear between the liner and the key.

Here, the ring body and the key may be formed of the same material. The liner may be made of a different material from the Oldham ring. This can reduce the weight of the Oldham ring and suppress friction loss and wear between the Oldham ring and the liner.

Advantageous Effects of Invention

In a scroll compressor according to the present disclosure, a plurality of fixing protrusions may be disposed spaced apart from each other on a key constituting an Oldham ring, and a plurality of fixing grooves may be disposed spaced apart from each other in an orbiting scroll or a ring body of the Oldham ring, to which the key is coupled, such that the plurality of fixing protrusions are inserted. This can reduce the weight of the Oldham ring to enhance motor efficiency, while preventing the key constituting the Oldham ring from being separated from the orbiting scroll or ring body due to a difference in thermal strain.

In a scroll compressor according to the present disclosure, a plurality of fixing protrusions and a plurality of fixing grooves may be formed in pairs and spaced apart from each other along at least one of a circumferential direction and a radial direction. Through this, the key can be prevented from being separated from the orbiting scroll or Oldham ring even if the surrounding temperature conditions of the orbiting scroll or Oldham ring change during operation, thereby enhancing reliability.

In a scroll compressor according to the present disclosure, fixing protrusions may extend in an axial direction from both circumferential side surfaces of a key. Through this, the weight of the key can be reduced while smoothly performing a function of restricting the rotation of an orbiting scroll, and at the same time, both radial ends of the key can be open to increase an oil supply effect on the key and a key groove.

In a scroll compressor according to the present disclosure, a plurality of fixing protrusions may be connected to each other into a ring shape, and a plurality of fixing grooves may be connected to each other into a ring shape. This can reduce the weight of the key, effectively prevent the separation of the key due to thermal deformation, and secure the cross-sectional area of the key to increase support strength.

In a scroll compressor according to the present disclosure, a plurality of fixing protrusions may be spaced apart from each other to be in parallel, and a plurality of fixing grooves may be spaced apart from each other to be in parallel. With the configuration, a key can be fixed uniformly along its longitudinal direction and more effectively be prevented from being separated due to thermal deformation.

In a scroll compressor according to the present disclosure, a hollow portion may be defined between inner surfaces of both circumferential side surfaces and inner surfaces of both radial side surfaces, and one end portion of each of the circumferential side surfaces and one end portion of each of the radial side surfaces may form fixing protrusions. This can reduce the weight of a key, effectively prevent the separation of the key due to thermal deformation, and secure the cross-sectional area of the key to increase support strength.

In a scroll compressor according to the present disclosure, an axial side surface connecting both circumferential side surfaces and both radial side surfaces may further be provided. This can secure rigidity of the circumferential and radial side surfaces, thereby enhancing reliability of a key.

In a scroll compressor according to the present disclosure, an axial side surface may have a through hole formed therethrough to have a cross-sectional area smaller than a cross-sectional area of a hollow portion. This can prevent refrigerant from being filled in a key and allow a predetermined amount of oil to be stored in the key, thereby reducing friction loss during restart of the compressor.

In a scroll compressor according to the present disclosure, a circumferential side surface and a fixing protrusion may be formed on the same axis. This can secure the cross-sectional area of a key, thereby increasing support strength.

In a scroll compressor according to the present disclosure, an oil supply groove may be formed in an outer surface of at least one of both circumferential side surfaces or an oil supply hole may be formed to penetrate between the outer surface and an inner surface of the at least one circumferential side surface. With this configuration, a certain amount of oil can be smoothly supplied between a key and a key groove, reducing friction loss.

In a scroll compressor according to the present disclosure, an oil supply groove may be formed in a circumferential inner surface of a key groove facing a circumferential side surface of the key. With this configuration, a certain amount of oil can be smoothly supplied between a key and the key groove, reducing friction loss.

In a scroll compressor according to the present disclosure, a key groove may be formed in one of an orbiting scroll and an Oldham ring, a liner may be inserted into a key groove, a liner fixing groove may be formed in one circumferential side surface or both circumferential side surfaces of the key groove to be spaced apart from the key groove with at least a portion overlapping the key groove in a circumferential direction, and a liner fixing jaw may be formed between the key groove and the liner fixing groove. Through this, the weight of the Oldham ring can be further reduced by making the Oldham ring using a single material, while the separation of the liner disposed between the Oldham ring and the orbiting scroll can be prevented, thereby enhancing reliability.

In a scroll compressor according to the present disclosure, a liner body portion and the liner fixing portion, which constitute portions of the liner, may overlap a side surface of a liner fixing jaw in a circumferential direction. This can effectively suppress the separation of the liner due to a difference of thermal strain between an orbiting scroll and the liner.

In a scroll compressor according to the present disclosure, a liner insertion groove may be recessed by a preset depth axially into an axial cross-section of a liner fixing jaw, so that a liner extension portion can be inserted. Accordingly, the liner can be hidden in an orbiting scroll and collision with neighboring members can be prevented during the orbiting movement of the orbiting scroll, thereby stabilizing the behavior of the orbiting scroll.

In a scroll compressor according to the present disclosure, an oil supply groove may further be formed in an inner surface of a liner body portion to extend in a radial direction. Accordingly, a certain amount of oil can be supplied between the liner and a key, thereby preventing friction loss and wear between the liner and the key.

MODE FOR THE INVENTION

Figure 1:
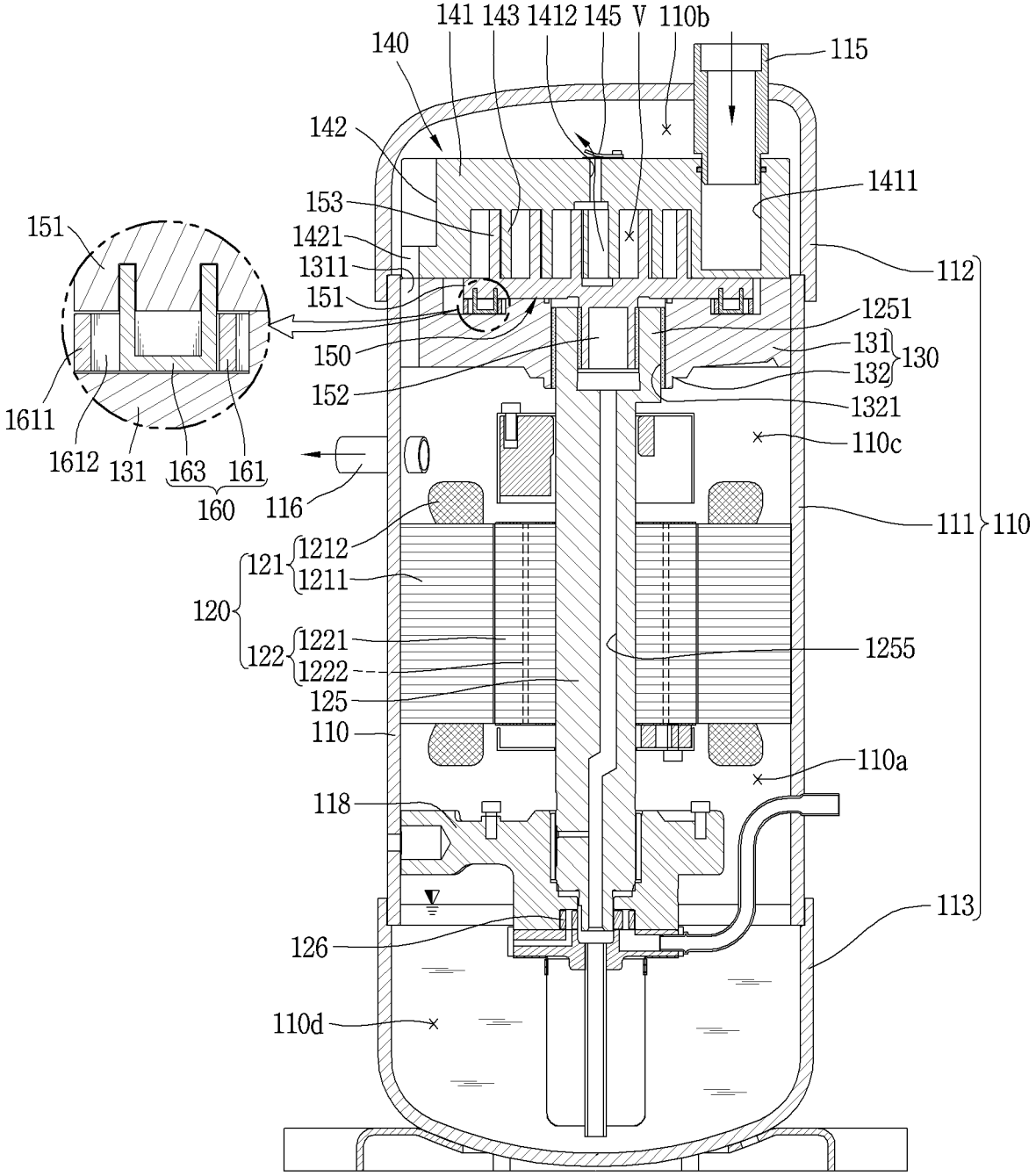
FIG. 1 is a sectional view illustrating a scroll compressor in accordance with an embodiment of the present disclosure.

Description will now be given in detail of a scroll compressor according to exemplary embodiments disclosed herein, with reference to the accompanying drawings.

A scroll compressor may be classified as a hermetic type or an open type depending on whether a drive motor and a compression unit are all installed in an inner space of a casing. In the hermetic type, the drive motor and the compression unit are installed together in the inner space of the casing, and in the open type, the drive motor (or drive source) is installed outside the casing. This embodiment will be described mainly based on the hermetic scroll compressor. However, the present disclosure may also be equally applied to the open type scroll compressor.

Scroll compressors may also be classified into a fixed scroll compressor and a movable scroll compressor. The fixed type is usually applied for air conditioning in a building, and the movable type is applied for air conditioning in a vehicle. This embodiment will be described mainly based on the fixed type scroll compressor. However, the present disclosure may also be equally applied to the movable type scroll compressor.

In addition, scroll compressors may be classified into a low-pressure type and a high-pressure type depending on pressure of refrigerant filled in an inner space of a casing. In the low-pressure type, the inner space of the casing is filled with refrigerant of suction pressure. In contrary, in the high-pressure type, the inner space of the casing is filled with refrigerant of discharge pressure. This embodiment will be described mainly based on the high-pressure type scroll compressor. However, the present disclosure may also be equally applied to the low-pressure type scroll compressor.

In addition, scroll compressors may be classified into a top-compression type and a bottom-compression type depending on an installation position of a compression unit. The top-compression type includes a compression unit disposed above a drive motor while the bottom-compression type includes a compression unit disposed below a drive motor. This embodiment will be described mainly based on the top-compression type scroll compressor. However, the present disclosure may also be equally applied to the bottom-compression type scroll compressor.

Scroll compressors may also be classified into a one-sided rotation scroll compressor and an inter-rotation scroll compressor depending on whether scrolls rotate. The one-sided rotation scroll compressor is configured such that one scroll is fixed or restricted from rotating and the other scroll pivots, while the inter-rotation scroll compressor is configured such that both scrolls rotate. This embodiment will be described mainly based on the one-sided rotation scroll compressor. However, the present disclosure may also be equally applied to the inter-rotation scroll compressor.

In addition, the scroll compressor according to the embodiment of the present disclosure may be applied equally to most types of scroll compressors to which the Oldham ring is applied.

FIG. 1 is a sectional view illustrating a scroll compressor in accordance with an embodiment of the present disclosure.

Referring to FIG. 1, a scroll compressor according to an embodiment of the present disclosure may include a drive motor 120 disposed in a lower-half portion of a casing 110, and a main frame 130 disposed above the drive motor 120. A compression unit is installed on an upper side of the main frame 130. The compression unit includes a fixed scroll 140 and an orbiting scroll 150, and in some cases, the main frame 130 may also be described as being included in the compression unit.

The casing 110 may include a cylindrical shell 111, an upper cap 112, and a lower cap 113. Accordingly, an inner space 110*a* of the casing 110 may be divided into an upper space 110*b* defined inside the upper cap 112, an intermediate space 110*c* defined inside the cylindrical shell 111, and a lower space 110*d* defined inside the lower cap 113, based on an order that refrigerant flows. Hereinafter, the upper space 110*b* may be defined as a discharge space, the intermediate space 110*c* may be defined as an oil separation space, and the lower space 110*d* may be defined as an oil storage space, respectively.

The cylindrical shell 111 has a cylindrical shape with upper and lower ends open, and the drive motor 120 and the main frame 130 are press-fitted to an inner circumferential surface of the cylindrical shell 111 in a lower half portion and an upper half portion, respectively.

A refrigerant discharge pipe 116 is inserted through the intermediate space 110*c* of the cylindrical shell 111, in detail, coupled through a gap between the drive motor 120 and the main frame 130. The refrigerant discharge pipe 116 may be directly inserted into the cylindrical shell 111 to be welded thereon. Alternatively, an intermediate connecting pipe (i.e., collar pipe) typically made of the same material as the cylindrical shell 111 may be inserted into the cylindrical shell 111 to be welded thereon, and then the refrigerant discharge pipe 116 made of copper may be inserted into the intermediate connection pipe to be welded thereon.

The upper cap 112 is coupled to cover the upper opening of the cylindrical shell 111. A refrigerant suction pipe 115 is coupled through the upper cap 112. The refrigerant suction pipe 115 is inserted through the upper space 110*b* of the casing 110 to be directly connected to a suction chamber of the compression unit to be described later. Accordingly, refrigerant can be supplied into a suction chamber through the refrigerant suction pipe 115.

The lower cap 113 is coupled to cover the lower opening of the cylindrical shell 111. The lower space 110*d* of the lower cap 113 defines an oil storage space in which a preset amount of oil can be stored. The lower space 110*d* defining the oil storage space may communicate with the upper space 110*b* and the intermediate space 110*c* of the casing 110 through an oil return passage. Accordingly, oil separated from refrigerant in the upper space 110*b* and the intermediate space 110*c* and oil returned after being supplied to the compression unit can all be returned into the lower space 110*d* defining the oil storage space through an oil return passage to be stored therein.

Referring to FIG. 1, the drive motor 120 according to this embodiment is disposed in a lower half part of the intermediate space 110*c* defining a high-pressure part at the inner space 110*a* of the casing 110, and includes a stator 121 and a rotor 122. The stator 121 is shrink-fitted to an inner wall surface of the casing 111, and the rotor 122 is rotatably provided inside the stator 121.

The stator 121 includes a stator core 1211 and a stator coil 1212.

The stator core 1211 is formed in a cylindrical shape and is shrink-fitted onto the inner circumferential surface of the cylindrical shell 111. The stator coil 1212 may be wound around the stator core 1211 and may be electrically connected to an external power source through a terminal (no reference numeral given) that is coupled through the casing 110.

The rotor 122 may include a rotor core 1221 and permanent magnets 1222.

The rotor core 1221 is formed in a cylindrical shape, and is rotatably inserted into the stator core 1211 with a preset gap therebetween. The permanent magnets 1222 are embedded in the rotor core 1222 at preset distances along the circumferential direction.

The rotational shaft 125 is press-fitted to the rotor 122. An upper end portion of the rotational shaft 125 is provided with an eccentric portion and rotatably supported on the main frame 130 to be described later in the radial direction, and a lower end portion of the rotational shaft 125 is rotatably supported on a sub frame 118 in the radial and axial directions.

In addition, an oil supply hole 1255 may be formed inside the rotational shaft 125 to penetrate through between both ends of the rotational shaft 125. The oil supply hole 1255 may penetrate from a lower end of the rotational shaft 125 to a bottom surface of the eccentric portion 1251. Accordingly, oil stored in the lower space 110*d* defining the oil storage space can be supplied into the eccentric portion 1251 through the oil supply hole 1255.

An oil pickup 126 may be installed at the lower end of the rotational shaft 125, precisely, at a lower end of the oil supply hole 1255. The oil pickup 126 may be disposed to be submerged in the oil stored in the oil storage space 110*d*. Accordingly, the oil stored in the oil storage space 110*d* can be pumped by the oil pickup 126 to be suctioned upward through the oil supply hole 1255.

Referring to FIG. 1, the main frame 130 is disposed on an upper side of the drive motor 120, and shrink-fitted to or welded on an inner wall surface of the cylindrical shell 111. Accordingly, the main frame 130 is usually formed of cast iron.

The main frame 130 includes a main flange portion 131 and a shaft support protrusion 132.

The main flange portion 131 is formed in an annular shape and accommodated in the intermediate space 110*a* of the cylindrical shell 111. For example, an outer circumferential surface of the main flange portion 131 may be formed in a circular shape to be in close contact with the inner circumferential surface of the cylindrical shell 111. In this case, at least one oil return hole may axially penetrate between outer and inner circumferential surfaces of the main flange portion 131.

In addition, at least one frame fixing protrusion may radially extend from the outer circumferential surface of the main flange portion 131. An outer circumferential surface of the at least one frame fixing protrusion may be fixed in close contact with the inner circumferential surface of the cylindrical shell 111. In this case, the at least one frame fixing protrusion may include a second discharge passage groove 1311 that penetrates through between both side surfaces of the main flange portion in the axial direction. The second discharge passage groove 1311 may be formed to communicate with the first discharge passage groove 1421 to be explained later on the same axis. Accordingly, the upper space 110*b* and the intermediate space 110*c* may communicate with each other, so that refrigerant discharged from the compression unit to the upper space 110*b* moves to the intermediate space 110*c* and is discharged toward the condenser through the refrigerant discharge pipe 116.

Additionally, an Oldham ring receiving portion may be formed in the upper surface of the main flange portion 131, and a first key groove may be formed in the Oldham ring receiving portion. Two first key grooves may be formed with a phase difference of approximately 180° along the circumferential direction.

First keys 162 of the Oldham ring 160, which will be described later, may be slidably inserted in the first key grooves in the radial direction. In this case, a liner as an anti-wear member may be inserted into each first key groove, or the first key 162 of the Oldham ring 160 inserted into the first key groove may be made of a different material from the ring body 161 of the Oldham ring 160.

For example, if the main frame 130 is made of the same material as the first key 162 of the Oldham ring 160, a liner that is made of a different material from the main frame 130 or the Oldham ring 160 may be disposed to suppress wear between the main frame 130 and the Oldham ring 160. Alternatively, the first key 162 may be post-assembled to the ring body 161 defining the Oldham ring 160, and may be made of a different material from the main frame 130. However, as in the embodiment of the present disclosure, the main frame 130 and the ring body 161 of the Oldham ring 160 are made of different materials (for example, the main frame is made of cast iron and the first key of the Oldham ring is made of aluminum), there is no need to install a separate liner in the first key groove.

The shaft support protrusion 132 extends from the center of the main flange portion 131 toward the drive motor 120 and a shaft support hole 1321 is formed inside the shaft support protrusion 132. The shaft support hole 1321 may be formed through both axial side surfaces of the main flange portion 131. Accordingly, the main flange portion 131 may have an annular shape.

Referring to FIG. 1, the fixed scroll 140 according to the embodiment of the present disclosure may include a fixed end plate 141, a fixed side wall portion 142, and a fixed wrap 143.

The fixed end plate 141 may be formed in a disk shape. An outer circumferential surface of the fixed end plate 141 may be in close contact with an inner circumferential surface of the upper cap 112 defining the upper space 110*b* or may be spaced apart from the inner circumferential surface of the upper cap 112.

A suction port 1411 may be formed through an edge of the fixed end plate 141 in the axial direction to communicate with a suction chamber. The refrigerant suction pipe 115 may be inserted into the suction port 1411 through the upper cap 112 of the casing 110. Accordingly, the refrigerant suction pipe 115 can directly communicate with the suction port 1411 of the fixed scroll 140 through the upper space 110*b* of the casing 110.

A discharge port 1412 and a bypass hole may be formed through a center of the fixed end plate 141. A discharge valve 145 for opening and closing the discharge port 1412 and a bypass valve for opening and closing the bypass hole may be disposed on an upper surface of the fixed end plate 141. Accordingly, refrigerant compressed in a compression chamber V may be discharged from an upper side of the fixed scroll 140 into the upper space 110*b* defined in the upper cap 112.

The fixed side wall portion 142 may extend in an annular shape from an edge of the fixed end plate 141 toward the main frame 130. Accordingly, a lower surface of the fixed side wall portion 142 may be coupled by bolts in close contact with an upper surface of the main frame 130, that is, an upper surface of the main flange portion 131.

At least one first discharge passage groove 1421 may be formed at an outer circumferential surface of the fixed side wall portion 142. The first discharge passage groove 1421 may be recessed into an outer circumferential surface of the fixed scroll 140 such that both axial side surfaces of the fixed scroll 140 communicate with each other. For example, an upper surface of the fixed end plate 141 and a lower surface of the fixed side wall portion 142 may communicate with each other through the first discharge passage groove 1421. Accordingly, an upper end of the first discharge passage groove 1421 can communicate with the upper space 110*b* and a lower end of the first discharge passage groove 1421 can communicate with an upper end of the second discharge passage groove 1311 formed at the main frame 130.

The fixed wrap 143 may extend from a lower surface of the fixed end plate 141 toward the orbiting scroll 150. The fixed wrap 143 may be formed in various shapes, such as an involute shape. The fixed wrap 143 may be engaged with an orbiting wrap 153 to be described later to define a pair of compression chambers V.

Referring to FIG. 1, the orbiting scroll 150 according to the embodiment of the present disclosure may include an orbiting end plate 151, a rotational shaft coupling portion 152, and an orbiting wrap 153.

The orbiting end plate 151 may be formed in a disk shape and supported axially by the main frame 130 so as to perform an orbiting motion between the main frame 130 and the fixed scroll 140.

Second keys 163 forming portions of the Oldham ring 160, which will be described later, may be disposed in one side surface of the orbiting end plate 151, that is, in a side surface opposite to the orbiting wrap 153. The second keys 163 may be disposed with a phase difference of approximately 180° along the circumferential direction.

The second keys 163 may extend axially toward the Oldham ring 160 to be slidably inserted in the radial direction into second key grooves 1612 of the Oldham ring 160, which will be described later. The second keys 163 will be described later together with the Oldham ring.

The rotational shaft coupling portion 152 may extend from a geometric center of the orbiting scroll 150 toward the eccentric portion 1251 of the rotational shaft 125. The rotational shaft coupling portion 152 may be rotatably inserted into the eccentric portion 1251 of the rotational shaft 125. Accordingly, the orbiting scroll 150 can perform the orbiting motion by the eccentric portion 1251 of the rotational shaft 125 and the rotational shaft coupling portion 152.

The orbiting wrap 153 may extend from an upper surface of the orbiting end plate 151 toward the fixed scroll 140. The orbiting wrap 153 may be formed in various shapes such as an involute shape to correspond to the fixed wrap 143.

The Oldham ring 160 may be disposed between the main frame 130 and the orbiting scroll 150. However, in some cases, the Oldham ring 160 may be disposed between the fixed scroll 140 and the orbiting scroll 150. In the embodiment of the present disclosure, an example in which the Oldham ring 160 is disposed between the main frame 130 and the orbiting scroll 150 will be mainly described.

For example, the Oldham ring 160 may be slidably coupled to each of the main frame 130 and the orbiting scroll 150. Accordingly, the Oldham ring 160 restricts the rotation of the orbiting scroll 150 such that the orbiting scroll 150 performs an orbiting motion relative to the main frame 130. The Oldham ring 160 will be described later again.

The scroll compressor according to the embodiment can obtain the following operating effects.

That is, when power is applied to the drive motor 120 and rotational force is generated, the orbiting scroll 160 eccentrically coupled to the rotational shaft 125 performs an orbiting motion relative to the fixed scroll 140 by the Oldham ring 160. At this time, a pair of compression chambers V that consecutively move are formed between the fixed scroll 140 and the orbiting scroll 150.

Then, the compression chambers V are gradually reduced in volume as they move from the suction port 1411 (or suction chamber) to the discharge port 1412 (or discharge chamber) while the orbiting scroll 150 is performing the orbiting motion.

Refrigerant is then introduced into the compression chambers through the suction port 1411 of the fixed scroll 140 via the refrigerant suction pipe 115. The refrigerant is compressed while moving toward the final compression chamber by the orbiting scroll 150. The refrigerant is discharged from the final compression chamber into the upper space 110*b* of the casing 110 through the discharge port 1412 of the fixed scroll 140, and then moves to the intermediate space 110*c* or/and the lower space 110*d* of the casing 110 through a refrigerant guide passage defined by the first discharge passage groove 1421 and the second discharge passage groove 1311.

Oil is separated from the refrigerant while the refrigerant circulates in the inner space 110*a* of the casing 110. The oil separated from the refrigerant flows to be filled in the oil storage space defining the lower space 110*d* of the casing 110 and then is supplied to the compression unit through the oil pickup 126 and the oil supply hole 1255 of the rotational shaft 125. On the other hand, the refrigerant from which the oil has been separated is discharged to the outside of the casing 110 through the refrigerant discharge pipe 116. Such processes are repeated.

Meanwhile, as described above, the orbiting scroll is slidably coupled to the Oldham ring and makes an orbital movement with respect to the fixed scroll or/and the main frame. Accordingly, it is advantageous in terms of increasing motor efficiency that the orbiting scroll and Oldham ring are made of materials as light as possible.

Accordingly, in the related art, a technology of manufacturing the orbiting scroll and the Oldham ring using aluminum alloy materials (hereinafter, referred to as aluminum) is known. In this case, the ring body and the second key of the Oldham ring may be made of different materials. Here, the ring body may be made of aluminum, which is the same material as the orbiting scroll, while the second key may be made of an iron-based material such as cast iron, which is a different material from the material of the orbiting scroll.

However, as in Patent Document 1, when the second key is inserted into a fixing protrusion formed on the ring body, not only the thickness of the fixing protrusion may become thin to decrease mechanical reliability, but also the second key may be separated due to a difference in thermal strain between the ring body and the second key. Even in the case where the liner is inserted into the second key groove of the orbiting scroll as in Patent Document 2, the liner may be separated due to a difference in thermal strain between the orbiting scroll and the liner.

Accordingly, in the embodiment of the present disclosure, the ring body and key of the Oldham ring may be formed of different materials and post-assembled or the key may be provided with an anti-wear coating layer and post-assembled, and double or plural press-fit surfaces may be formed between the ring body and the key. This can secure rigidity at an area where the ring body and the key of the Oldham ring are coupled to each other while suppressing in advance the separation of the key due to the difference in thermal strain between the ring body and the key. Hereinafter, the description will focus on an example in which the ring body and key constituting the Oldham ring are formed of different materials.

Figure 2:
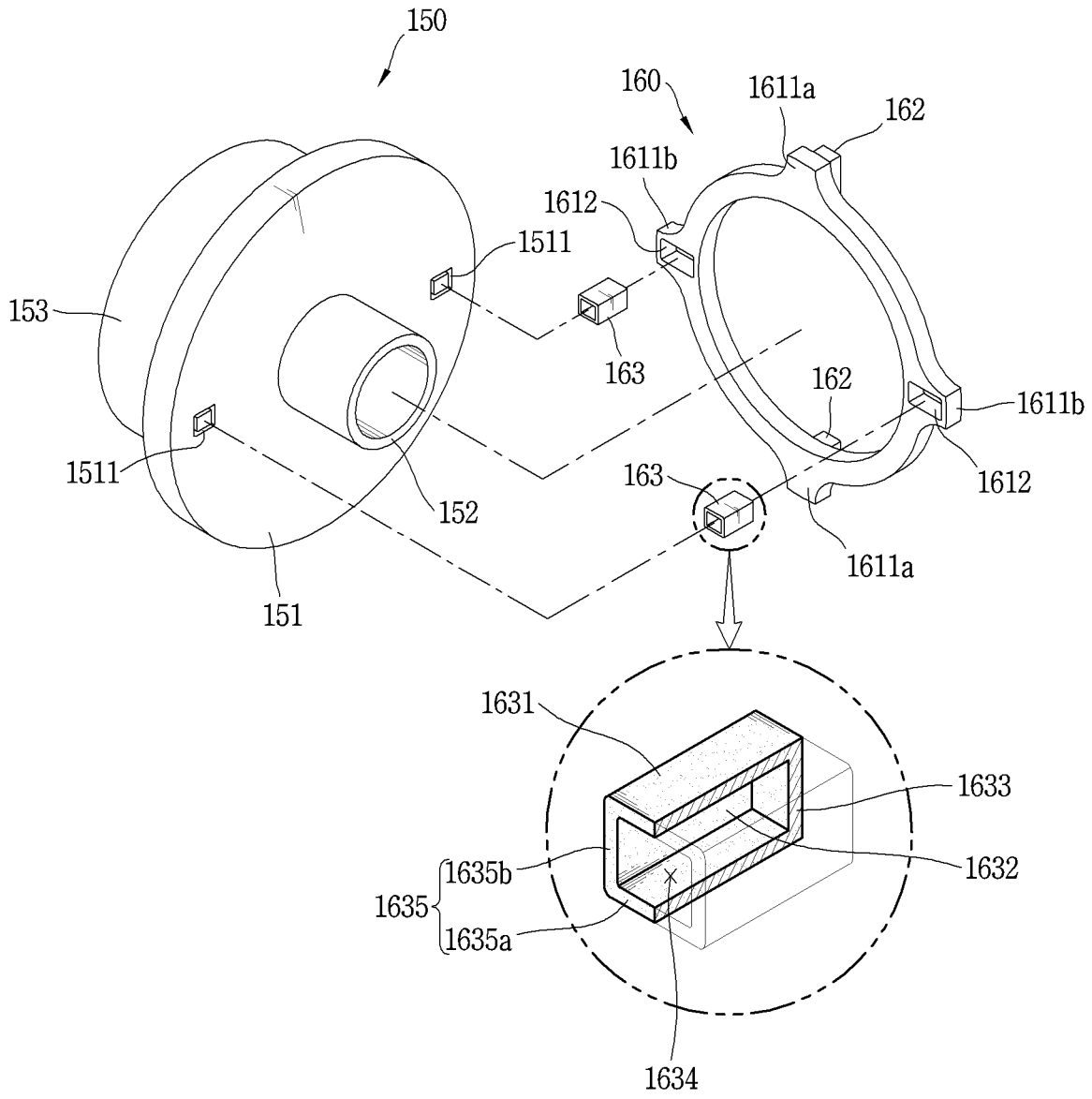
FIG. 2 is an exploded perspective view illustrating a portion of a compression unit in FIG. 1.
Figure 3:
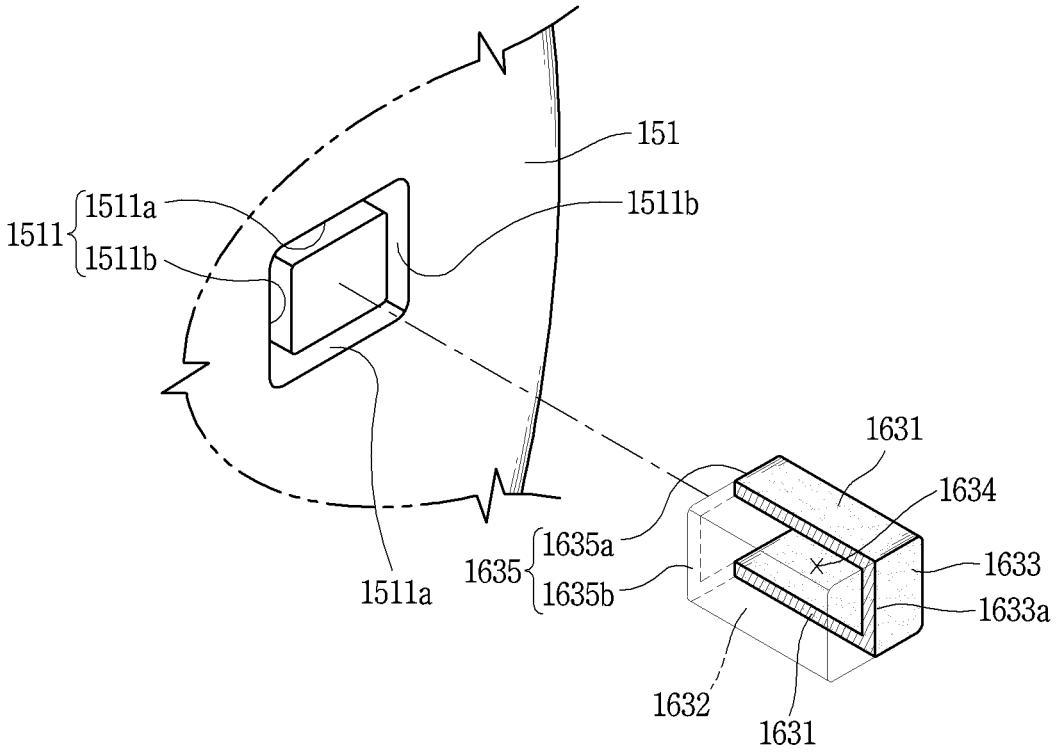
FIG. 3 is an exploded perspective view illustrating a state where a second key is separated from an orbiting scroll in FIG. 2.
Figure 4:
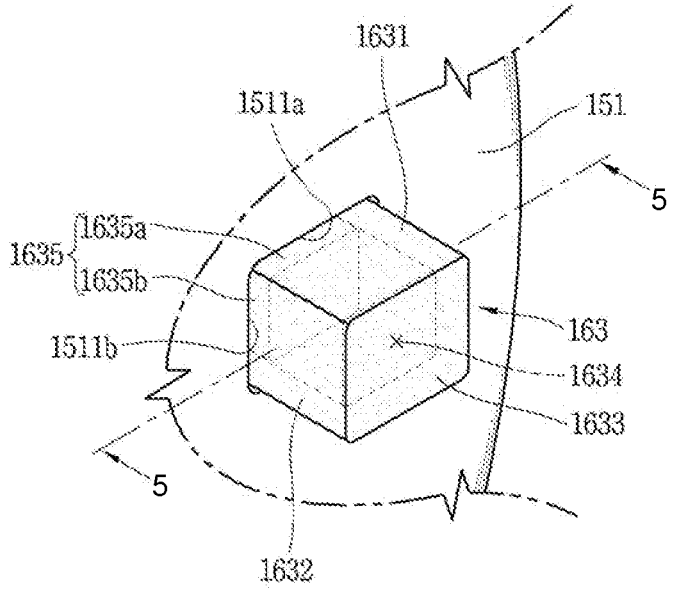
FIG. 4 is a perspective view illustrating a state where the second key is assembled to the orbiting scroll in FIG. 3.
Figure 5:
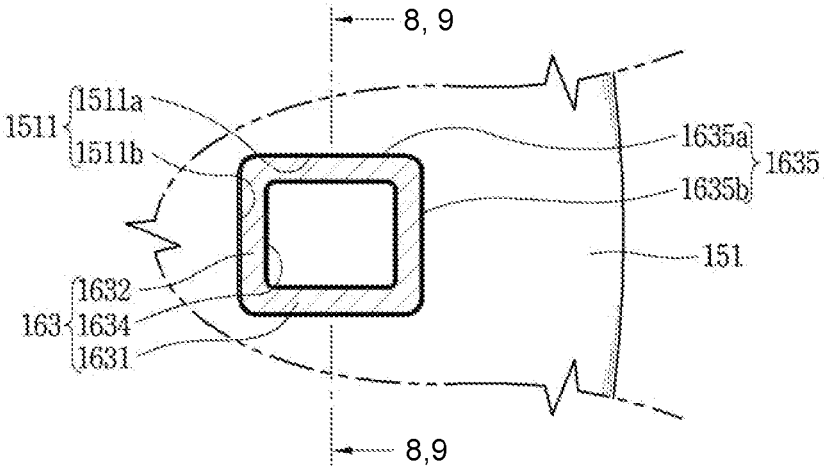
FIG. 5 is a sectional view taken along the line "5-5" of FIG. 4.
Figure 6:
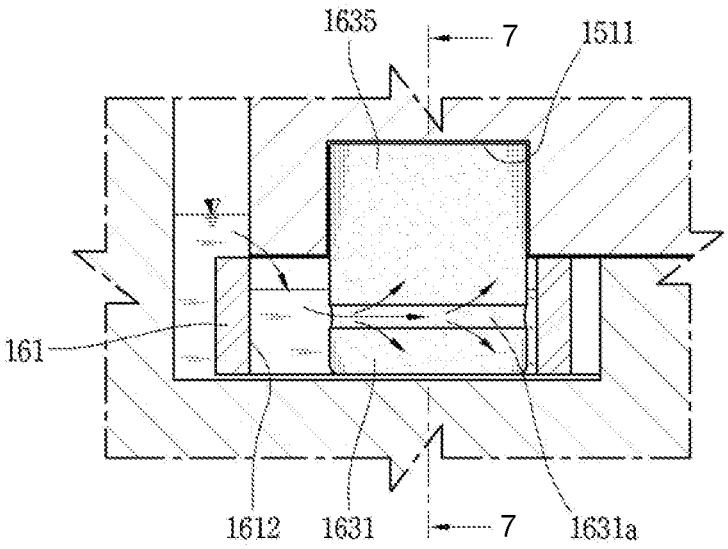
FIG. 6 is a front view for explaining another embodiment of the second key.
Figure 7:
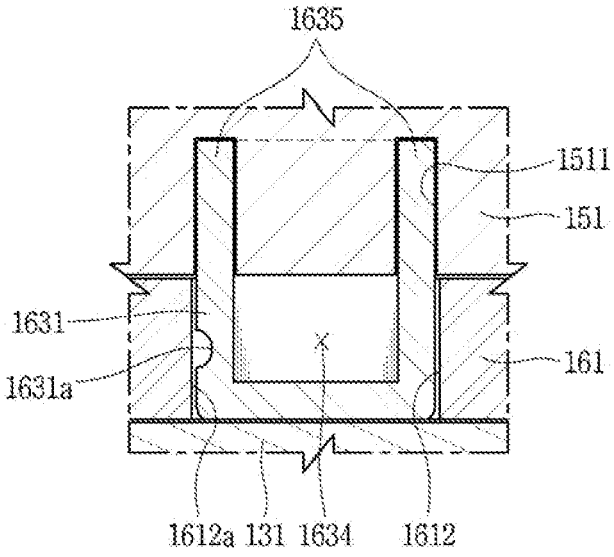
FIG. 7 is sectional view taken along the line "7-7" of FIG. 6.

FIG. 2 is an exploded perspective view illustrating a portion of a compression unit in FIG. 1, FIG. 3 is an exploded perspective view illustrating a state where a second key is separated from an orbiting scroll in FIG. 2, FIG. 4 is a perspective view illustrating a state where the second key is assembled to the orbiting scroll in FIG. 2, FIG. 5 is a sectional view taken along the line "5-5" of FIG. 4, FIG. 6 is a front view for explaining another embodiment of the second key, and FIG. 7 is sectional view taken along the line "7-7" of FIG. 6.

Referring to FIGS. 2 to 5, the Oldham ring 160 according to the embodiment may include a ring body 161, first keys 162, and second keys 163.

The first key 162 and the second key 163 may be formed of different materials from the ring body 161, and one of the first key 162 and the second key 163 may be formed of the same material as the ring body 161 while another key may be formed of a different material from the ring body 161. This embodiment will be described focusing on an example in which the first key 162 is made of the same material as the ring body 161 and the second key 163 is made of a different material from the ring body 161.

Specifically, the ring body 161 may be formed of the same material as the orbiting scroll 150, that is, an aluminum material. Cast iron used for the main frame 130 or the fixed scroll 140 has the specific gravity of about 785, and aluminum alloy has the specific gravity of about 28. Accordingly, when the ring body 161 of the Oldham ring 160 is made of aluminum, the weight of the Oldham ring 160 can be reduced, suppressing the increase in vibration noise caused due to the reciprocating movement of the Oldham ring 160 during high-speed operation and simultaneously reducing the manufacturing cost for the Oldham ring 160.

The ring body 161 may be formed in an annular shape. The ring body 161 may be formed in a circular shape, or in some cases, may be formed in an oval shape. This embodiment will be mainly described based on an example in which the ring body 161 is formed in the circular shape.

The ring body 161 may be formed in the circular shape, and expansion portions 1611 may be formed at appropriate locations along the circumferential direction. The expansion portions 1611 are portions where the Oldham ring 160 is coupled to the main frame 130 and the orbiting scroll 150, and may be formed at approximately 90° intervals.

The expansion portions 1611 may extend in the radial direction. For example, the expansion portions 1611 may extend radially from the outer circumferential surface of the ring body 161, or in some cases, may extend radially from the inner circumferential surface of the ring body 161. Of course, the expansion portions 1611 may extend radially from the outer and inner circumferential surfaces of the ring body 161, respectively. This embodiment will be described focusing on an example in which the expansion portions 1611 extend radially from the outer circumferential surface of the ring body 161.

The expansion portions 1611 may extend long in the radial direction to secure the radial length of the first keys 162 and/or the second keys 163. This can secure the radial lengths of the first keys 162 and the second keys 163 sufficiently to suppress the rotational movement of the orbiting scroll 150 while minimizing the radial width of the ring body 161, thereby suppressing an increase in weight of the Oldham ring 160.

The expansion portions 1611 may also extend in the axial direction. For example, the expansion portions 1611 may extend in the axial direction by a preset height from one or both side surfaces of the ring body 161 in the axial direction. Accordingly, the ring body 161 may be formed such that an axial height (thickness) thereof at the expansion portion 1611 is higher (greater) than an axial height (thickness) in an area except for the expansion portion 1611. Therefore, an axial side surface of the ring body 161 at the portion with the expansion portion 1611 can be in contact with the main frame 130 or the orbiting scroll 150 to be supported in the axial direction. Through this, the Oldham ring 160 can be disposed to be slidable between the main frame 130 and the orbiting scroll 150, and also the weight of the Oldham ring 160 can be reduced.

Additionally, the first keys 162 and the second keys 163 may integrally extend from or may be post-assembled to the axial side surfaces of the expansion portions 1611. For example, the expansion portions 1611 may include two first expansion portions 1611*a* and two second expansion portions 1611*b*. The two first expansion portions 1611*a* and the two second expansion portions 1611*b* may alternatively be disposed along the circumferential direction.

The first expansion portion 1611*a* may be formed with both axial side surfaces flat, and the first key 162 may integrally extend in the axial direction from one side surface (lower surface) of each first expansion portion 1611*a* toward the first key groove of the main frame 130. Accordingly, the first expansion portion 1611*a*, which defines a portion of the ring body 161, may be formed of the same material as the first key 162.

The second expansion portion 1611*b* may be formed with both axial side surfaces flat, and a second key groove 1612 may be formed to penetrate from one side surface (upper surface) to another side surface (lower surface) of each second expansion portion 1611*b*. The second key 163 disposed on the orbiting scroll 150 may be slidably inserted in the radial direction into the second key groove 1612.

The second key groove 1612 may be formed long in the radial direction. For example, the second key groove 1612 may be formed in a rectangular shape that is long in the radial direction. The second key groove 1612 may be formed in a long hole shape where both circumferential side surfaces are closed and both radial side surfaces are closed. However, in some cases, both circumferential side surfaces of the second key groove 1612 may be closed, while one of the two radial side surfaces may be open. In this case, oil can be smoothly supplied to the second key groove 1612, thereby reducing friction loss and wear.

As described above, the first key 162 may extend downward from one side surface of the first expansion portion 1611*a* constituting the ring body 161 toward the first key groove. Accordingly, the first key 162 may be made of aluminum, which is the same material as the ring body 161. This may be applied when the main frame 130 into which the first key 162 is slidably inserted is made of a different material, for example, cast iron, from the Oldham ring 160. When the main frame 130 is made of the same material as the Oldham ring 160, that is, aluminum, the first key 162 may also be post-assembled to the main frame 130 like the second key 163, which will be described later. In this case, the ring body 161 may be provided with the first key grooves on both sides of the second key groove 1612 in the circumferential direction, so that the first keys 162 can be slidably coupled thereto in the radial direction.

Each of the second keys 163 may generally be formed in a rectangular box shape, and one end of the second key 163 facing a relevant fixing groove portion 1511, which will be described later, may be open to be inserted into the fixing groove portion 1511.

The fixing groove portion 1511 may be formed, as described above, in one side surface of the orbiting end plate 151, that is, in the lower surface of the orbiting end plate 151 facing the Oldham ring 160, so that one end of the second key 163 can be inserted. The fixing groove portion 1511 may be formed to correspond to a fixing protrusion portion 1635.

Specifically, the fixing groove portion 1511 may be recessed by a preset depth so that the fixing protrusion portion 1635 of the second key 163, which will be described later, is inserted. For example, the fixing groove portion 1511 may be formed so that one side surface facing the fixing protrusion portion 1635 of the second key 163 is open and another side surface is closed.

The fixing groove portion 1511 may preferably be formed to be as deep as possible, in terms of stably supporting the second key 163. For example, the axial depth of the fixing groove portion 1511 may be lower than the axial height of the second key 163 and lower than the axial thickness of the orbiting end plate 151. The axial depth of the fixing groove 1511 may preferably be approximately ½ or more of the axial thickness of the orbiting end plate 151.

The fixing groove portion 1511 may be provided in plurality in the orbiting end plate 151. For example, each of the fixing groove portions 1511 may include a plurality of circumferential fixing grooves 1511*a* and a plurality of radial fixing grooves 1511*b*.

The circumferential fixing grooves 1511*a* and the radial fixing grooves 1511*b* may be formed to have the same length. However, the circumferential fixing groove 1511*a* and the radial fixing groove 1511*b* may be formed differently. For example, circumferential side surfaces 1631 of the second key 163 to be explained later may be slidably in contact with the circumferential fixing grooves 1511*a* of the fixing groove portion 1511, to prevent the rotational movement of the orbiting scroll 150. Due to this, the circumferential side surfaces 1631 of the second key 163 may receive a greater load than radial side surfaces 1632, so the second key 163 may be formed such that the length of the circumferential fixing protrusion portion 1635, which will be described later, is longer than the length of the radial fixing protrusion portion 1635. Accordingly, the fixing groove portion 1511 may also be formed so that the length of the circumferential fixing groove 1511*a* is longer than the length of the radial fixing groove 1511*b*.

Additionally, the plurality of circumferential fixing grooves 1511*a* may be spaced apart from each other by a preset distance along the circumferential direction, and the plurality of radial fixing grooves 1511*b* may be spaced apart from each other by a preset distance along the radial direction.

The plurality of circumferential fixing grooves 1511*a* and the plurality of radial fixing grooves 1511*b* may be independently disposed with being spaced apart from each other, but in some cases, both ends of the circumferential fixing grooves 1511*a* and both ends of the radial fixing grooves 1511*b* may be connected into a ring shape, for example, a cross-sectional shape like "D" when projected axially, as illustrated in FIG. 5.

Meanwhile, since the second key 163 is fixedly inserted into the fixing groove portion 1511 as described above, the fixing protrusion portion 1635, which defines a portion of the second key 163, may be formed to correspond to the fixing groove portion 1511. For example, the second key 163 may include circumferential side surfaces 1631, radial side surfaces 1632, an axial side surface 1633, a hollow portion 1634, and a fixing protrusion portion 1635.

The circumferential side surfaces 1631 may be provided as a pair of left and right surfaces to be inserted into the circumferential fixing grooves 1511*a* described above, and may be disposed in parallel to each other at a preset distance in the circumferential direction. The circumferential side surfaces 1631 may each have outer and inner surfaces that are flat. Accordingly, the circumferential side surfaces 1631 can be slidably coupled in the radial direction while being supported in the circumferential direction on the circumferential inner surfaces 1612*a* of the second key groove 1612.

The second key 163 may be formed such that the left and right circumferential side surfaces 1631 have the same thickness. This can facilitate manufacturing of the second key 163 including the circumferential side surfaces 1631. However, in some cases, both the circumferential side surfaces 1631 may have different thicknesses. In this case, the circumferential side surface 1631 on a side in contact with the first key groove may be formed to be thicker than the other. Accordingly, the rigidity and wear resistance reliability of the second key 163 can be improved.

Additionally, the circumferential side surfaces 1631 may be formed to have the same thickness as the radial side surfaces 1632 or/and the axial side surface 1633. This can facilitate manufacturing of the second key 163 including the circumferential side surfaces 1631, the radial side surfaces 1632, and the axial side surface 1633. However, in some cases, the circumferential side surfaces 1631 may be formed to be thicker than the radial side surfaces 1632 or/and the axial side surface 1633. Accordingly, the rigidity and wear resistance of the circumferential side surfaces 1631, which constitute substantial friction surfaces, can be improved, thereby enhancing the rigidity and wear resistance reliability of the second key 163.

Also, the circumferential side surfaces 1631 may be formed in a closed shape. Accordingly, surface pressure on the circumferential side surfaces 1631 can be reduced, thereby suppressing the wear of the circumferential side surfaces 1631 of the second key 163. However, in some cases, the circumferential side surfaces 1631 may partially be open or recessed. For example, as illustrated in FIGS. 6 and 7, an oil supply groove 1631*a* may be formed in the circumferential side surface 1631 of the second key 163 facing the circumferential inner surface 1612*a* of the second key groove 1612. The oil supply groove 1631*a* may be formed to traverse between both ends of the circumferential side surface 1631 along the radial direction at the mid-height of the circumferential side surface 1631. In this case, oil can smoothly flow between the circumferential side surface 1631 of the second key 163 and the circumferential inner surface 1612*a* of the second key groove 1612 facing the circumferential side surface 1631.

An oil supply groove may be formed in the circumferential inner surface 1612*a* of the second key groove 1612. In this case, the circumferential side surface 1631 of the second key 163 may be formed in a closed shape to increase the wear resistance of the circumferential side surface 1631 of the second key 163.

The radial side surfaces 1632 may be configured as a pair on inner and outer sides to be inserted into the radial fixing grooves 1511*b* described above, and may be disposed in parallel to each other at a preset distance in the radial direction. The inner radial side surface 1632 may connect the inner ends of the circumferential side surfaces 1631 to each other, and the outer radial side surface 1632 may connect the outer ends of the circumferential side surfaces 1631 to each other. Accordingly, the fixing protrusion portion 1635 of the second key 163, which will be described later, may be formed in a shape corresponding to the fixing groove portion 1511 as described above, that is, the cross-sectional shape like "D" when projected axially as illustrated in FIG. 5.

The radial side surfaces 1632 may be formed in a closed shape, or in some cases, may be formed in an at least partially open shape. When the radial side surface 1632 is formed in the closed shape, the circumferential side surface 1631 can be more firmly supported. The shape in which the radial side surface 1632 is open will be described later in another embodiment.

The axial side surface 1633 may be formed on one end of both axial ends of the second key 163, which is opposite to the fixing protrusion portion 1635, which will be described later, and another end of the circumferential side surface 1631 and another end of the radial side surface 1632 may be connected to each other by the axial side surface 1633. Accordingly, the circumferential side surfaces 1631 of the second key 163 can be supported by the radial side surfaces 1632 of the second key 163 and the axial side surface 1633 of the second key 163. Through this, the circumferential side surfaces 1631 of the second key 163 can be slidably in contact with the circumferential inner surfaces 1612*a* of the second key groove 1612, resulting in maintaining rigidity without deformation even if a load is applied in the circumferential direction.

The axial side surface 1633 may be formed in a closed shape or in a partially open shape. The partially open shape of the axial side surface 1633 will be described later in another embodiment.

The hollow portion 1634 may be defined by the inner surfaces of the circumferential side surfaces 1631, the inner surfaces of the radial side surfaces 1632, and the inner side surface of the axial side surface 1633. The volume of the hollow portion 1634 may be inversely proportional to the weight of the second key 163. Therefore, the volume of the hollow portion 1634 may preferably be formed as large as possible, in terms of reducing the weight of the second key 163, namely, the Oldham ring 160.

The hollow portion 1634 may be excluded or may be formed to a minimum even if it is provided. For example, in the embodiment of the present disclosure, each circumferential side surfaces 1631, each radial side surfaces 1632, and the axial side surface 1633 may be formed to have the same thickness, but in some cases, at least one of the circumferential side surface 1631 or the radial side surface 1633 may be formed to be thinner or thicker than the other side surface. Accordingly, the hollow portion 1634 may alternatively be formed to be larger or smaller than an empty space defined inside the fixing protrusion portion 1635, which will be described later.

The fixing protrusion portion 1635 may be formed on one end portion of the circumferential side surface 1631 and one end portion of the radial side surface 1632. In other words, the fixing protrusion portion 1635 may include a circumferential fixing protrusion 1635*a* formed on the end portion of the circumferential side surface 1631, opposite to the axial side surface 1633, and a radial fixing protrusion 1635*b* formed on the end portion of the radial side surface 1632, opposite to the axial side surface 1633.

The fixing protrusion portion 1635 may be formed to correspond to the fixing groove portion 1511 as described above. For example, as illustrated in FIG. 5, a plurality of circumferential fixing protrusions 1635*a* and a plurality of radial fixing protrusions 1635*b* may be connected to form a cross-sectional shape like "D" when projected in the axial direction. Accordingly, when the fixing protrusion portion 1635 is inserted into the fixing groove portion 1511, the outer surface of the fixing protrusion portion 1635 may be disposed to face the outer surface of the fixing groove portion 1511, and the inner surface of the fixing protrusion portion 1635 may be disposed to face the inner surface of the fixing groove portion 1511.

The circumferential fixing protrusions 1635*a* may extend flat with the same thickness as the circumferential side surfaces 1631, and the radial fixing protrusions 1635*b* may extend flat with the same thickness as the radial side surfaces 1632. In other words, the circumferential fixing protrusions 1635*a* may be formed flat not to be stepped with respect to the circumferential side surfaces 1631 on the same axis, and the radial fixing protrusions 1635*b* may be formed flat not to be stepped with respect to the radial side surfaces 1632 on the same axis. This can increase the cross-sectional area of the fixing protrusion portion configured by the circumferential fixing protrusions 1635*a* and the radial fixing protrusions 1635*b*, thereby defining an empty space in the fixing protrusion portion 1635 and securing the rigidity of the fixing protrusion portion 1635.

The circumferential fixing protrusions 1635*a* may protrude in the circumferential direction more than the circumferential side surfaces 1631, or/and the radial fixing protrusions 1635*b* may protrude in the radial direction more than the radial side surfaces 1632. In this case, the cross-sectional area of the circumferential fixing protrusion 1635*a* or/and the radial fixing protrusion 1635*b* can increase, further improving the rigidity and wear resistance of the fixing protrusion portion 1635.

The fixing protrusion portion 1635 of the second key 163 according to an embodiment of the present disclosure may be fixedly press-fitted to the fixing groove portion 1511 of the orbiting end plate 151. In other words, the fixing groove portion 1511 and the fixing protrusion portion 1635 may each have the cross-sectional shape like "D". Accordingly, when the compressor is stopped, the outer surface and the inner surface of the fixing protrusion portion 1635 may be almost or fully in contact with the outer surface and the inner surface of the fixing groove portion 1511, respectively, to be continuously in a press-fitted state.

On the other hand, when the compressor is in operation, the orbiting scroll 150 may thermally expand or contract depending on ambient temperature conditions, but the thermal deformation of the orbiting end plate 151 may be greater than the thermal deformation of the second key 163. As a result, the orbiting end plate 151 and the second key 163 may be spaced apart from each other and thereby the second key 163 may be separated from the orbiting end plate 151. However, as the second key 163 has a plurality of press-fit surfaces as in the embodiment of the present disclosure, the second key 163 can remain in close contact with the orbiting end plate 151 even during the operation of the compressor, so as to be suppressed from being separated from the orbiting end plate 151.

Figure 8:
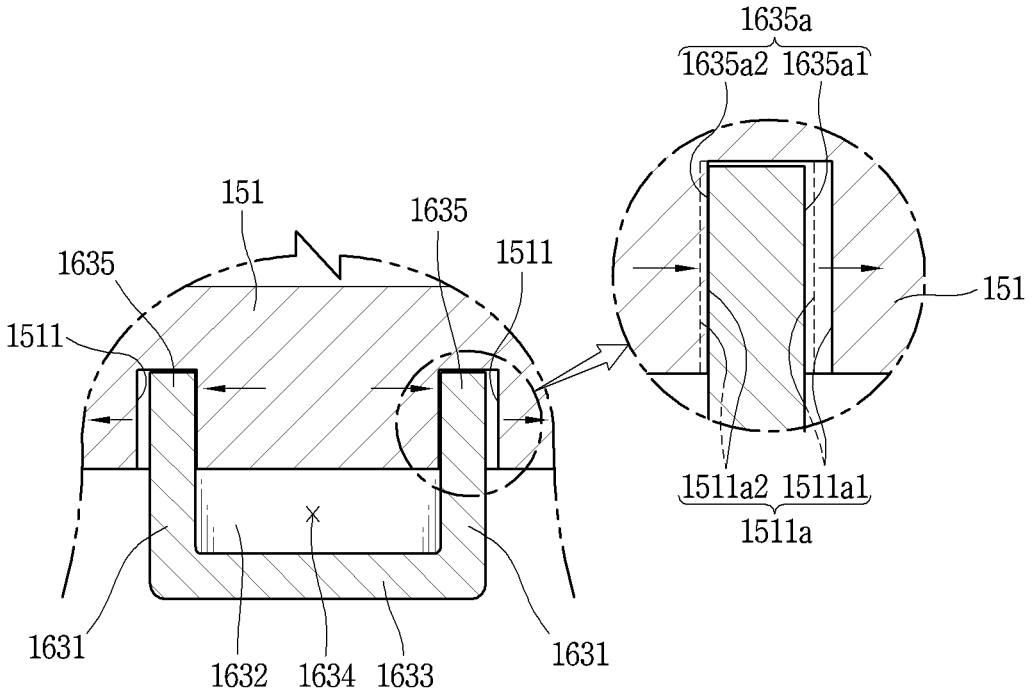
FIGS. 8 and 9 are sectional views taken along the line "8,9-8,9" of FIG. 5, which explains a process of fixing the second key according to temperature changes.
Figure 9:
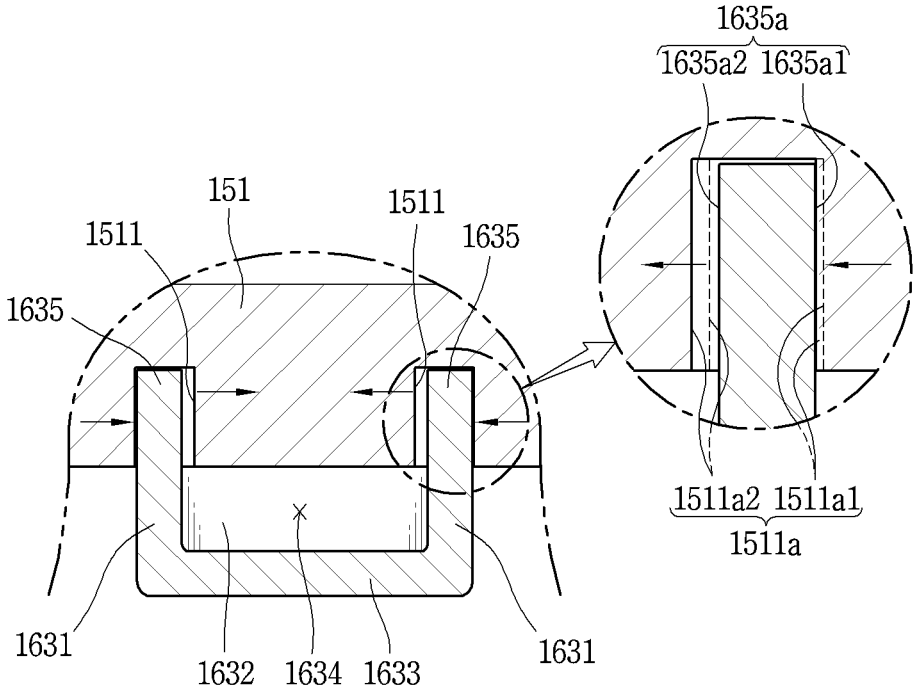

FIGS. 8 and 9 are sectional views taken along the line "8,9-8,9" of FIG. 5, which explains a process of fixing the second key according to temperature changes.

Referring to FIG. 8, in a high temperature state, the orbiting end plate 151 thermally expands more than the second key 163. At this time, in the case where the ring body (corresponding to the orbiting end plate of the embodiment) and the second key are formed in a column shape to have a single press-fit surface as in the related art (Patent Document 1), the ring body and the second key 163 may be spaced apart from each other due to the difference of the thermal expansion, and thereby the second key 163 may be separated.

However, in the embodiment of the present disclosure, the fixing groove portion 1511 of the orbiting end plate 151 and the fixing protrusion portion 1635 of the second key 163 may be formed in a ring shape, so that a plurality of press-fit surfaces can be defined between the fixing groove portion 1511 of the orbiting end plate 151 and the fixing protrusion portion 1635 of the second key 163. Accordingly, the outer surface of the fixing groove portion 1511 with a great thermal expansion can expand more than the outer surface of the fixing protrusion portion 1635 with a small thermal expansion, so that a gap can be generated between the outer surface of the fixing groove portion 1511 and the outer surface of the fixing protrusion portion 1635 facing it. On the other hand, the inner surface of the fixing groove 1511 with a greater thermal expansion can expand more than the inner surface of the fixing protrusion portion 1635 with a small thermal expansion, so that the inner surface of the fixing groove portion 1511 can be in close contact with the inner surface of the fixing protrusion portion 1635.

In other words, the outer surface 1511*a*1 of the circumferential fixing groove 1511*a* may be thermally expanded to be spaced apart from the outer surface 1635*a*1 of the circumferential fixing protrusion 1635*a*, but the inner surface 1511*a*2 of the circumferential fixing groove 1511*a* may be thermally expanded to be in closer contact with the inner surface 1635*a*2 of the circumferential fixing protrusion 1635*a*. The same occurs even at the radial fixing groove 1511*b* and the radial fixing protrusion 1635*b*. Accordingly, even if the orbiting end plate 151 and the second key 163 are made of different materials with different thermal strains, the separation of the second key 163 from the orbiting end plate 151 can be effectively suppressed during operation in a high temperature state.

On the other hand, in a low temperature state, a phenomenon opposite to that in the high temperature state may occur, and the second key 163 may remain fixed to the orbiting end plate 151. Referring to FIG. 9, in the low temperature state, the orbiting end plate 151, which has a relatively high thermal strain, may be contracted more than the second key 163, which has a relatively low thermal strain.

For example, the inner surface 1511*a*2 of the circumferential fixing groove 1511*a* may be thermally contracted to be spaced apart from the inner surface 1635*a*2 of the circumferential fixing protrusion 1635*a*, but the outer surface 1511*a*1 of the circumferential fixing groove 1511*a* may be thermally contracted to be in closer contact with the outer surface 1635*a*1 of the circumferential fixing protrusion 1635*a*. The same occurs even at the radial fixing groove 1511*b* and the radial fixing protrusion 1635*b*. Accordingly, even if the orbiting end plate 151 and the second key 163 are made of different materials with different thermal strains, the separation of the second key 163 from the orbiting end plate 151 can be effectively suppressed during operation in the low temperature state.

In this way, when the orbiting scroll and the Oldham ring are made of the same material, the ring body of the Oldham ring may be made of the same material as the orbiting scroll to reduce the weight of the Oldham ring, while the second key may be made of a different material from the ring body to suppress friction loss between the orbiting scroll and Oldham ring.

In addition, when the orbiting scroll and the Oldham ring are made of the same material, the second key, which is made of the different material from the ring body of the Oldham ring, may be fixed to the orbiting scroll, and the second key may define a double press-fit surface with the orbiting scroll to be fixed to the orbiting scroll. Through this, even if the thermal strain of the orbiting scroll is greater than that of the second key, the separation of the second key from the orbiting scroll during operation can be effectively suppressed, thereby enhancing reliability.

In addition, the second key which is made of the different material from the orbiting scroll can be easily assembled to the orbiting scroll while securing the cross-sectional area, strengthening the support rigidity of the second key at a coupled portion to the orbiting scroll. This may result in enhancing reliability.

Hereinafter, a description will be given of another embodiment of the Oldham ring.

That is, in the previous embodiment, the hollow portion 1634 of the second key 163 is formed in the closed shape, but in some cases, a through hole may be formed through at least one of the side surfaces defining the second key 163.

Figure 10:
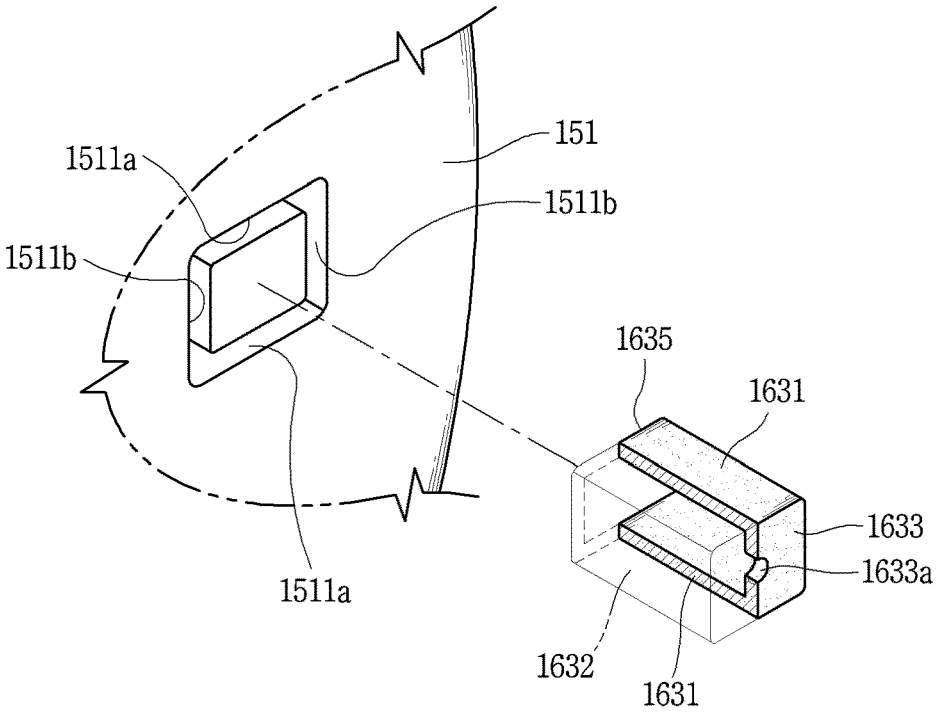
FIG. 10 is an exploded perspective view for explaining still another embodiment of the second key.

FIG. 10 is an exploded perspective view for explaining still another embodiment of the second key.

Referring to FIG. 10, the second key 163 according to this embodiment may include circumferential side surfaces 1631, radial side surfaces 1632, and an axial side surface 1633. The second key 163 including the circumferential side surfaces 1631 and the radial side surfaces 1632 may be formed almost the same as that in the previous embodiment. Accordingly, the orbiting end plate 151 and the fixing groove portion 1511 disposed in the orbiting end plate 151 are formed in the same manner as in the previous embodiment, and the resulting effects are the same as those in the previous embodiment, so a description thereof will be replaced with the description of the previous embodiment.

However, the axial side surface 1633 according to the embodiment may have at least one through hole 1633*a*. The through hole 1633*a* may be formed through the central portion of the axial side surface 1633 to be smaller than the area of the axial side surface 1633, for example, approximately ½ or less of the area of the axial side surface 1633.

The through hole 1633*a* may be formed in a circular shape, but in some cases, it may be formed in a long hole shape. When the through hole 1633*a* is formed in the long hole shape, it may be advantageous in terms of reliability that the through hole 1633*a* is formed long in the radial direction.

A through hole may be formed through the radial side surface 1632 or the circumferential side surface 1631 in addition to the axial side surface 1633. Since the radial side surface 1632 does not form a bearing surface with respect to the second key groove 1612, it may be formed on the inner radial side surface 1632 or the outer radial side surface 1632. The circumferential side surface 1631 may form the bearing surface with respect to the second key groove 1612, and a side surface of the rotational shaft 125 in a rotating direction may be in closer contact with the second key groove 1612. Accordingly, through holes may be formed through both the circumferential side surfaces 1631, respectively, and when a through hole is formed through one circumferential side surface 1631, it may be advantageous that the through hole is formed through an opposite side surface of the rotational shaft 125 in the rotating direction.

When the through hole 1633*a* is formed through the axial side surface (or another side surface) 1633 of the second key 163, refrigerant or air can quickly flow out of the hollow portion 1634 through the through hole 1633*a* even if the refrigerant or air is introduced into the hollow portion 1634 of the second key 163. Accordingly, the refrigerant or air can be filled and expanded inside the hollow portion 1634 to push the second key 163 away from the orbiting scroll 150, suppressing the second key 163 from being separated from the orbiting scroll 150.

Additionally, oil around the Oldham ring 160 can flow into the hollow portion 1634 through the through hole 1633*a* and be stored therein. This oil which is stored inside the hollow portion 1634 can lubricate a gap between the Oldham ring 160 and the orbiting scroll 150 when the compressor is restarted, thereby reducing friction loss and wear that may occur during restart.

Hereinafter, a description will be given of still another embodiment of the Oldham ring.

That is, in the previous embodiment, the axial side surface 1633 of the second key 163 is closed or open more than half, but in some cases, the axial side surface 1633 of the second key 163 may be excluded or may be open less than half of the cross-sectional area of the second key 163.

Figure 11:
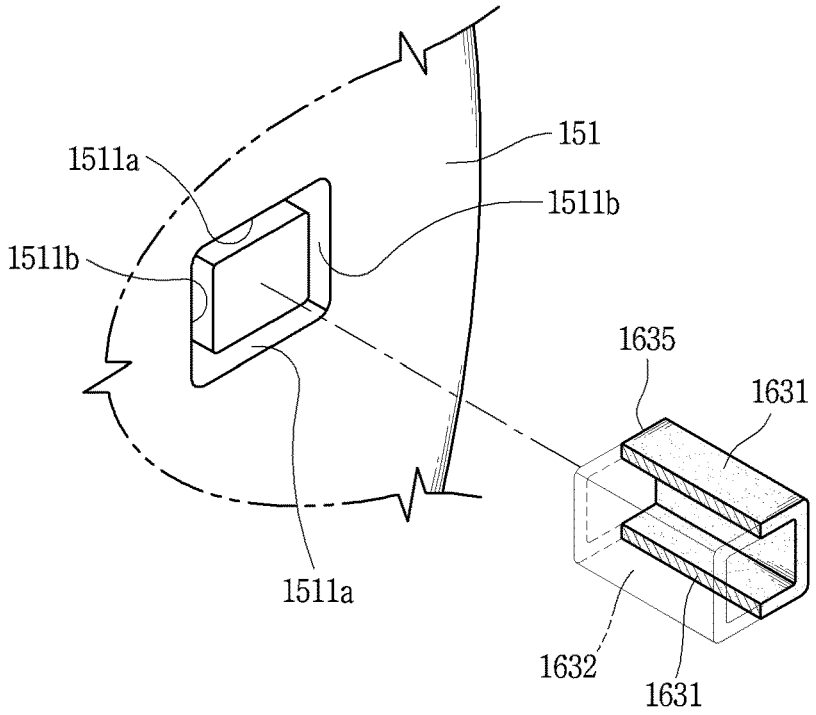
FIG. 11 is an exploded perspective view for explaining yet another embodiment of the second key.

FIG. 11 is an exploded perspective view for explaining still another embodiment of the second key.

Referring to FIG. 11, the second key 163 according to this embodiment may include circumferential side surfaces 1631, radial side surfaces 1632, and an axial side surface 1633. The second key 163 including the circumferential side surfaces 1631 and the radial side surfaces 1632 may be formed almost the same as that in the previous embodiment. Accordingly, the fixing groove portion 1511 disposed in the orbiting scroll 150 is formed in the same manner as in the previous embodiment, and the resulting effects are the same as those in the previous embodiment, so a description thereof will be replaced with the description of the previous embodiment.

However, the second key 163 according to this embodiment may be formed such that the axial side surface 1633 is excluded or is formed to be much smaller than the cross-sectional area of the second key 163. This embodiment illustrates an example in which the axial side surface 1633 is excluded. Accordingly, since both the axial side surfaces 1633 are open, the second key 163 may be configured by the circumferential side surfaces 1631 and the radial side surfaces 1632.

As described above, the second key 163 of the Oldham ring 160 is formed such that the circumferential side surface 1631 in sliding contact with the second key groove 1612 of the ring body 161 forms a bearing surface, and the radial side surface 1632 and the axial side surface 1633 do not substantially affect the anti-rotation function of the Oldham ring 160 even if they are spaced apart from members facing them.

Therefore, even if the axial side surface 1633 opposite the fixing protrusion portion 1635 is excluded as in this embodiment, the Oldham ring 160 suppress the rotation of the orbiting scroll 150 while sliding smoothly relative to the orbiting scroll 150. Rather, as the axial side surface 1633 opposite the fixing protrusion portion 1635 is excluded as in this embodiment, the weight of the second key 163, which has a relatively large specific gravity, can be reduced. This can reduce the overall weight of the Oldham ring 160, thereby improving motor efficiency.

Hereinafter, a description will be given of still another embodiment of the Oldham ring.

That is, in the previous embodiment, the radial side surfaces 1632 of the second key 163 extend from the circumferential side surfaces 1631 and the axial side surface 1633, but in some cases, the radial side surfaces 1632 may be excluded or may be open less than half.

Figure 12:
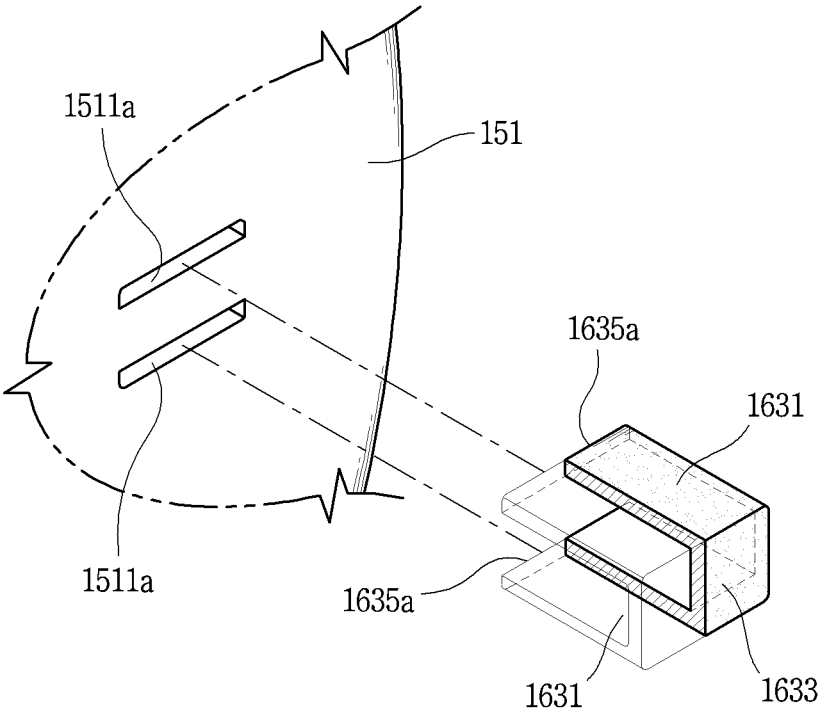
FIG. 12 is an exploded perspective view for explaining yet another embodiment of the second key.

FIG. 12 is an exploded perspective view for explaining still another embodiment of the second key.

Referring to FIG. 12, the second key 163 according to this embodiment may include circumferential side surfaces 1631, radial side surfaces 1632, and an axial side surface 1633. The second key 163 including the circumferential side surfaces 1631 and the axial side surface 1633 may be formed almost the same as that in the previous embodiment of FIG. 3. In other words, both the circumferential side surfaces 1631 may be connected to each other by the axial side surface 1633 at an upper end.

However, the second key 163 according to this embodiment may not have the radial side surfaces 1632. Accordingly, the fixing groove portion 1511 disposed in the orbiting scroll 150 may be formed differently from that in the previous embodiment.

Specifically, the fixing groove portion 1511 may include only both the circumferential fixing grooves 1511*a* by excluding both the radial fixing grooves 1511*b*. The circumferential fixing groove portions 1511*a* may extend in the radial direction and may be disposed in parallel with being spaced apart from each other by a preset distance in the circumferential direction, namely, by the circumferential width of the second key 163.

Even if the radial side surfaces 1632 are excluded from the second key 163 as in this embodiment, the second key 163 can be stably fixed to the fixing groove portion 1511 of the orbiting end plate 151. As explained in the previous embodiments, in a high temperature state, the inner surface 1635*a*2 of the circumferential fixing protrusion 1635*a* forming one end portion of the second key 163 may be fixedly in close contact with the inner surface 1511*a*2 of the circumferential fixing groove 1511*a* disposed in the orbiting end plate 151. On the other hand, in a low temperature state, the outer surface of the circumferential fixing protrusion 1635*a* forming one end portion of the second key 163 may be fixed in close contact with the outer surface of the circumferential fixing groove 1511*a* disposed in the orbiting end plate 151.

In addition, even if the radial side surfaces 1632 are excluded from the second key 163, the Oldham ring 160 according to this embodiment can smoothly play the role of preventing the rotation of the orbiting scroll 150 as in the previous embodiments. Rather, as the radial side surface 1632 is excluded as in this embodiment, the weight of the second key 163, which has a relatively large specific gravity, can be reduced. This can reduce the overall weight of the Oldham ring 160, thereby improving motor efficiency.

The radial side surface 1632 may be disposed to connect both the circumferential side surfaces 1631, that is, the middle portions of both the circumferential side surfaces 1631 and the axial side 1633. Accordingly, the combination of both the circumferential side surfaces 1631 and radial side surface 1632 may be formed in a cross-sectional shape like "H" when projected in the axial direction. In this case, since the single radial side surface 1632 is disposed, the weight of the key can be reduced and the rigidity of the circumferential side surface 1631 can be increased, to ensure the reliability of the second key 163.

Hereinafter, a description will be given of still another embodiment of the Oldham ring.

That is, in the previous embodiments, the second key 163 is fixedly coupled to the orbiting scroll 150 and slidably inserted into the ring body 161 of the Oldham ring 160. However, in some cases, the second key 163 may be fixedly coupled to the ring body 161 of the Oldham ring 160 and slidably inserted into the orbiting scroll 150.

Figure 13:
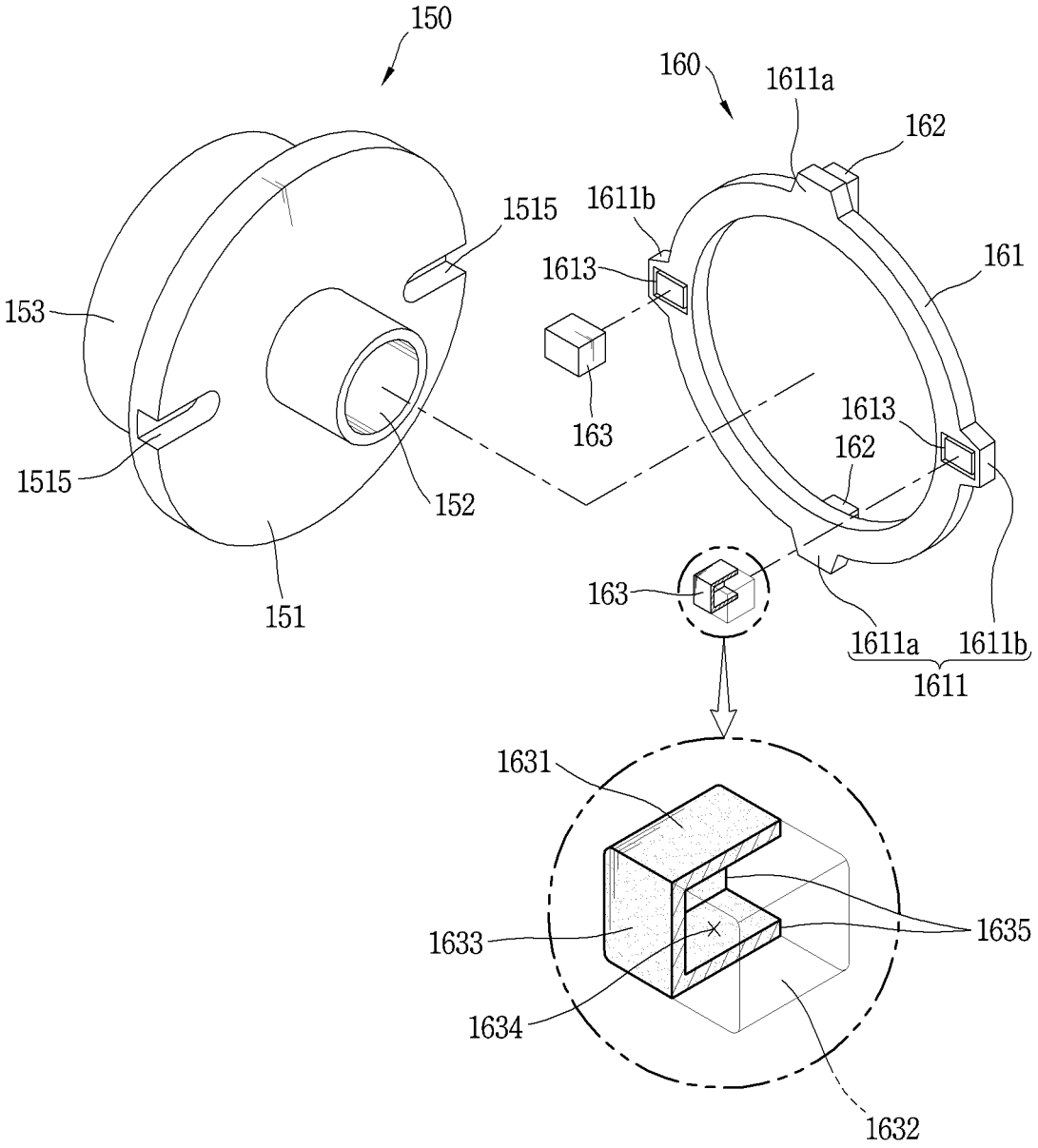
FIG. 13 is an exploded perspective view illustrating a portion of a compression unit for explaining another embodiment of an assembly position of the second key in FIG. 1.

FIG. 13 is an exploded perspective view illustrating a portion of the compression unit for explaining another embodiment of an assembly position of the second key in FIG. 1.

Referring to FIGS. 13, the Oldham ring 160 may include the ring body 161, the first keys 162, and the second keys 163. The basic shape and resulting effects of the ring body 161, the first keys 162, and the second keys 163 are similar to those of the previous embodiments, so a description thereof will be replaced with the description of the previous embodiments.

However, in this embodiment, a fixing groove portion 1613 may be formed in the ring body 161, and one end of the second key 163 may be coupled by press-fitting the fixing protrusion portion 1635 to the ring body 161. In this case, another end of the second key 163 may be slidably inserted into a second key groove 1515 formed in the orbiting end plate 151 in the radial direction.

As described above, even when the second key 163 is press-fitted to the ring body 161 of the Oldham ring 160, the fixing protrusion portion 1635 and the fixing groove portion 1613 may each be provided in plurality, and the plurality of fixing protrusion portions 1635 and the plurality of fixing groove portions 1613 may be spaced apart from each other. Accordingly, the second key 163 can be press-fitted into the ring body 161 while forming a double press-fit surface, to be stably fixed even if the ring body 161 has a greater thermal strain than the second key 163.

Hereinafter, a description will be given of another embodiment of an anti-wear member.

That is, in the previous embodiments, the ring body 161 and at least one key 162, 163 forming the Oldham ring 160 are formed of different materials, but in some cases, the ring body 161 and the key 162, 163 forming the Oldham ring 160 may be formed of the same material, and a separate anti-wear member (liner) 170 may alternatively be inserted into the second key groove 1515 that is formed in the orbiting scroll 150 (the fixed frame or/and the fixed scroll). Even in this case, the anti-wear member 170 may form a double press-fit surface or a plurality of press-fit surfaces with the second key groove 1515. Hereinafter, a description will focus on an example in which the anti-wear member 170 is inserted into the second key groove 1515 of the orbiting scroll 150.

Figure 14:
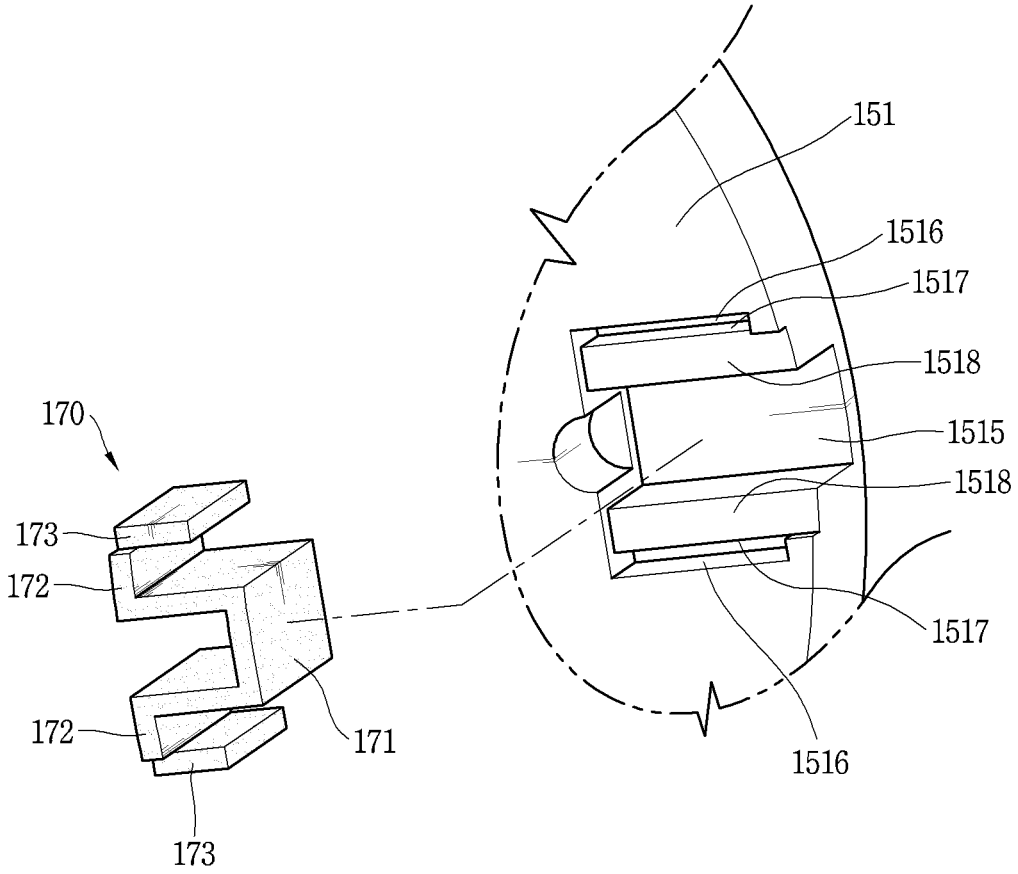
FIG. 14 is an exploded perspective view illustrating a second key groove of the orbiting scroll and an anti-wear member (liner) in FIG. 1.
Figure 15:
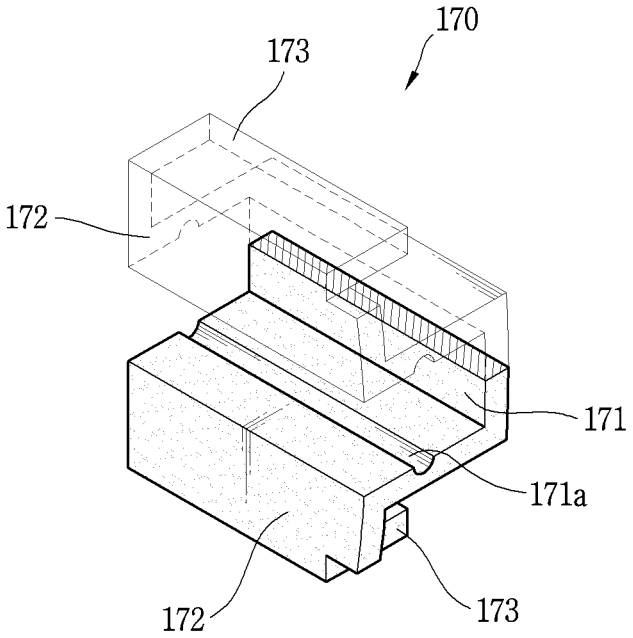
FIG. 15 is a longitudinal view illustrating another embodiment of the anti-wear member in FIG. 14.
Figure 16:
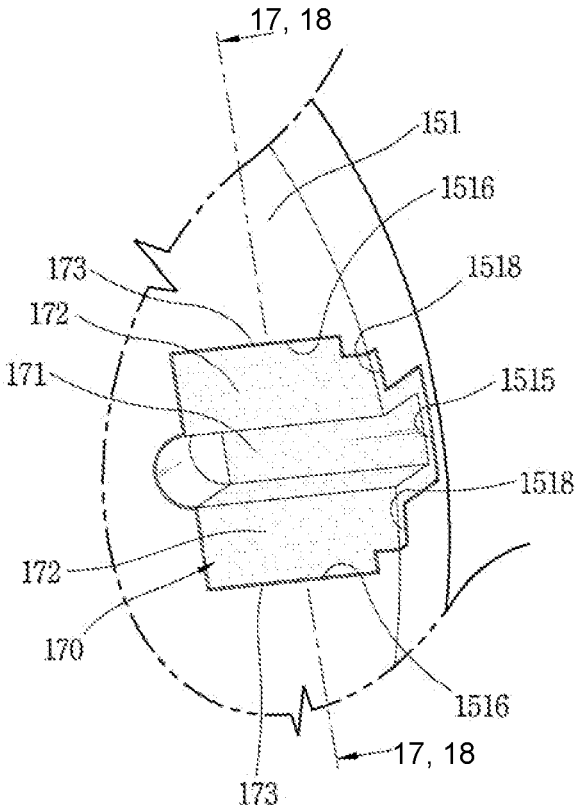
FIG. 16 is an assembled perspective of FIG. 14.
Figure 17:
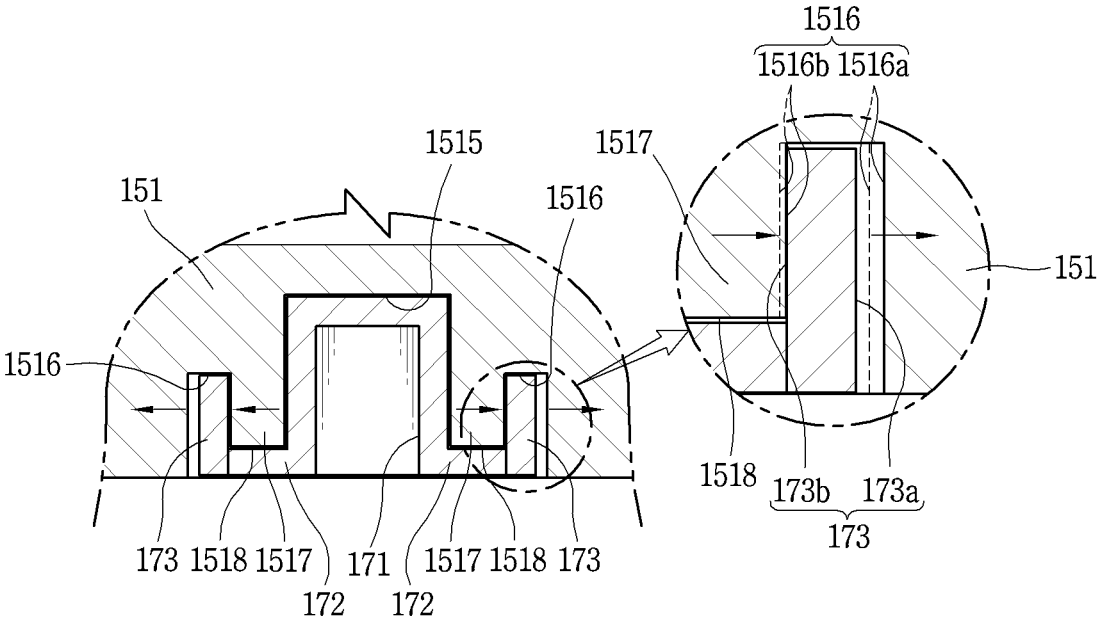
FIGS. 17 and 18 are sectional views taken along the line "17,18-17,18" of FIG. 16, which explains a process of fixing the anti-wear member according to temperature changes.
Figure 18:
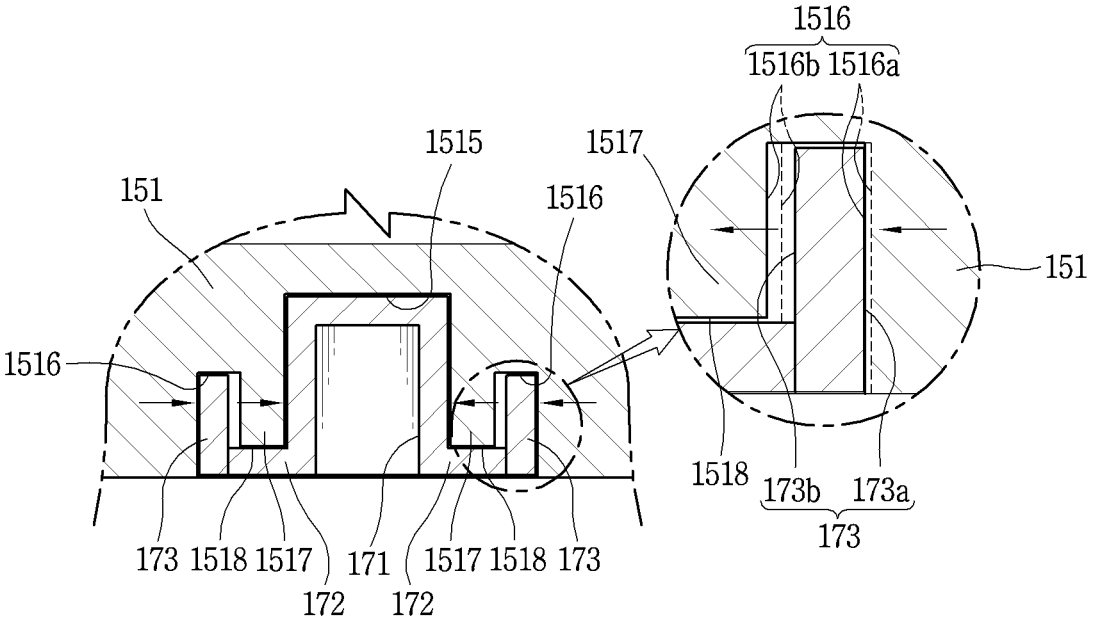

FIG. 14 is an exploded perspective view illustrating a second key groove of the orbiting scroll and the anti-wear member (liner) in FIG. 1, FIG. 15 is a longitudinal view illustrating another embodiment of the anti-wear member in FIG. 14, FIG. 16 is an assembled perspective of FIG. 14, and FIGS. 17 and 18 are sectional views taken along the line "17,18-17,18" of FIG. 16, which explains a process of fixing the anti-wear member according to temperature changes.

Referring back to FIG. 1, the scroll compressor according to this embodiment may include the Oldham ring 160, which is the anti-rotation member, between the main frame 130 and the orbiting scroll 150. Accordingly, the orbiting scroll 150 may form the compression chamber V with the fixed scroll 140 while performing the orbital movement relative to the main frame 130.

The Oldham ring 160 may include the first key 162 and the second key 163 on both axial side surfaces, respectively. The first key 162 may be slidably inserted into a first key groove disposed in the main frame 130 and the second key 163 may be slidably inserted into a second key groove 1515 disposed in the orbiting scroll 150. Accordingly, the Oldham ring 160 restrains the rotation of the orbiting scroll 150 eccentrically coupled to the rotational shaft 125 while reciprocating in all directions between the main frame 130 and the orbiting scroll 150 during the rotation of the rotational shaft 125.

As described above, as the Oldham ring 160 reciprocates in dependence on the drive motor 120 that generates rotational force, the Oldham ring 160 generates centrifugal force, and this centrifugal force affects the efficiency of the drive motor 120. Accordingly, it is advantageous in terms of motor efficiency that the Oldham ring 160 is formed as light as possible.

The Oldham ring 160 in the previous embodiments is formed such that the ring body 161 and the keys are formed of the different materials, but the Oldham ring 160 according to this embodiment may be formed such that both the first key 162 and the second key 163 are made of the same material as the ring body 161. This can further reduce the weight of the Oldham ring 160 and thus lower motor loss due to the centrifugal force of the Oldham ring 160. However, if the Oldham ring 160 is made of the same material as the orbiting scroll 150, the friction loss on the Oldham ring 160 and the orbiting scroll 150 may increase. Accordingly, in this embodiment, the Oldham ring 160 may be formed of a single material, and the anti-wear member 170 which is made of a different material from the Oldham ring 160 may be disposed in the second key groove 1515 of the orbiting scroll 150.

Referring to FIGS. 14 to 16, the orbiting scroll 150 according to this embodiment may include the orbiting end plate 151, the rotational shaft coupling portion 152, and the orbiting wrap 153. Since the basic structures and resulting effects of the orbiting end plate 151, the rotational shaft coupling portion 152, and the orbiting wrap 153 are almost the same as those of the previous embodiment, a detailed description thereof will be replaced with the description of the previous embodiment.

However, the orbiting end plate 151 according to this embodiment may include a liner fixing groove 1516 to be explained later that is formed near the second key groove 1515 such that the liner 170 as the anti-wear member is inserted in the second key groove 1515 while being fixed by a plurality of press-fit surfaces.

Specifically, the second key groove 1515 may extend long in the radial direction and may be formed in a cross-sectional shape like "U" with an outer circumferential side open and an inner circumferential side closed. The second key groove 1515 may be formed such that a spacing between both inner surfaces in the circumferential direction are approximately the same.

The liner fixing groove 1516 may be formed in each of both sides of the second key groove 1515 in the circumferential direction. Both the liner fixing grooves 1516 may be formed asymmetrically with respect to the second key groove 1515. However, both the liner fixing grooves 1516 according to this embodiment may be symmetrical with respect to the second key groove 1515. Accordingly, the liner 170 can be stably fixed by evenly receiving support force in the circumferential direction. Hereinafter, a description will be given, as a representative example, of the liner fixing groove 1516 on one side the second key groove 1515.

The liner fixing groove 1516 may be formed such that at least a portion thereof overlaps the second key groove 1515 in the circumferential direction. For example, the liner fixing groove 1516 may be formed to be deeper than or equal to the second key groove 1515. In this case, a liner fixing portion 173, which will be described later, may be pressed more tightly, so the liner 170 can be fixed more stably. However, considering the thickness of the orbiting end plate 151, the liner fixing groove 1516 may be formed to be shallower than or equal to the second key groove 1515.

A liner fixing jaw 1517 may be formed between the liner fixing groove 1516 and the second key groove 1515. Accordingly, the second key groove 1515 can be isolated from the liner fixing groove 1516 by the liner fixing jaw 1517.

The liner fixing groove 1516 may be formed in parallel to the second key groove 1515. For example, the liner fixing groove 1516 may be formed to be long in the radial direction like the second key groove 1515, but may be formed to be shorter than or equal to the second key groove 1515.

The liner fixing jaw 1517 may be formed to be smaller than or equal to the circumferential width of the second key groove 1515 or the circumferential width of the liner fixing groove 1516. Accordingly, the liner fixing groove 1516 may be formed close to the second key groove 1515, so that the length of a liner extension portion 172, which will be described later, can be minimized. Through this, the weight of the liner 170 can be minimized and an increase in the weight of the orbiting scroll 150 due to the liner 170 can be suppressed.

A liner insertion groove 1518 may be formed in the axial cross section of the liner fixing jaw 1517 to be recessed by a preset depth in the axial direction. The liner insertion groove 1518 is a portion, into which the liner extension portion 172 is inserted. The liner insertion groove 1518 may preferably have a sufficient depth not to expose the liner extension portion 172 to the outside of the orbiting end plate 151, for example, a depth greater than or equal to the thickness of the liner extension portion 172.

The liner fixing groove 1516 and the liner fixing jaw 1517 may be formed only on one side of the second key groove 1515 in the circumferential direction. Even in this case, the operating effect may be similar to that in the previous embodiment, that is, the structure in which the liner fixing groove 1516 and the liner fixing jaw 1517 are formed on each of both sides in the circumferential direction. However, when the liner fixing groove 1516 and the liner fixing jaw 1517 are formed at one side of the second key groove 1515 in the circumferential direction, the manufacturing and assembly process of the liner 170 can be simplified compared to that when they are formed at both sides of the second key groove 1515 in the circumferential direction.

Referring to FIGS. 14 and 15, the liner 170 according to this embodiment may be made of a material, for example, iron such as cast iron, with higher rigidity than the orbiting scroll 150 made of aluminum in a cutting manner or using a mold such as a powder metallurgy mold. Accordingly, the liner 170 may be formed with the same thickness, but each portion may be formed with a different thickness if necessary.

In detail, the liner 170 may include a liner body portion 171, liner extension portions 172, and liner fixing portions 173. The liner body portion 171, the liner extension portions 172, and the liner fixing portions 173 may be formed as an extended integral piece, or at least a portion may be post-assembled. This embodiment illustrates an example in which the liner body portion 171, the liner extension portions 172, and the liner fixing portions 173 are formed integrally.

The liner body portion 171 may be inserted into the second key groove 1515, so that the second key 163 can be slidably inserted. The liner body portion 171 may be formed in the shape of a long slit in the radial direction when projected in the axial direction, and may be formed in a cross-sectional shape like "U" when projected in the radial direction. Accordingly, the circumferential side surfaces 1631 of the second key 163 inserted into the liner body portion 171 may be slidably coupled to the inner surfaces (circumferential side surfaces) of the liner body portion 171, respectively.

The inner surface of the liner body portion 171 may be formed flat. However, in some cases, the inner surface of the liner body portion 171 may be formed to be recessed. For example, as illustrated in FIG. 15, an oil supply groove 171*a* may be formed long in the radial direction in the inner surface of the liner body portion. In this case, the oil supply groove 171*a* may extend along the radial direction of the liner body portion 171 up to an open end of an outer peripheral side.

When the oil supply groove 171*a* is formed in the inner surface of the liner body portion 171 as described above, the second key 163 may reciprocate inside the liner body portion 171 to generate a kind of pumping effect. Then, oil around the Oldham ring 160 may flows into the liner body portion 171 through the oil supply groove 171*a* by virtue of the pumping effect, thereby lubricating between the second key 163 and the liner body portion 171. The oil supply groove may alternatively extend in the axial direction.

The liner extension portions 172 may extend further in the circumferential direction from both ends of the liner body portion 171 in the circumferential direction, respectively. Each of the liner extension portions 172 may be bent in a transverse direction at the end of the liner body portion 171 and may extend flat. The liner extension portion 172 may be hidden by being inserted into the liner insertion groove 1518 of the orbiting scroll 150, and supported on the liner fixing jaw 1517 in the axial direction.

The liner fixing portion 173 may be bent and extend axially from the liner extension portion 172. The liner fixing portion 173 may have a length to be inserted into the liner fixing groove 1516, for example, a length to overlap the liner body portion 171 in the circumferential direction. Accordingly, the liner fixing portion 173 may overlap in the circumferential direction the side wall surface of the liner fixing jaw 1517, which is disposed on one side of the second key groove 1515 in the circumferential direction.

As the liner fixing grooves 1516 are formed at both sides of the second key groove 1515 in the circumferential direction with the liner fixing jaws 1517 interposed therebetween, at least one side surface of each liner fixing portion 173 inserted into the liner fixing groove 1516 may be fixedly pressed to the liner fixing groove 1516 regardless of the thermal deformation of the orbiting scroll 150.

FIG. 17 is a sectional view illustrating the relationship between the liner and the orbiting scroll during the thermal expansion of the orbiting scroll, and FIG. 18 is a cross-sectional view illustrating the relationship between the liner and the orbiting scroll during the thermal contraction of the orbiting scroll.

As illustrated in FIG. 17, during thermal expansion, the orbiting scroll 150, which has a relatively high thermal strain, is deformed in a direction away from the second key groove 1515. At this time, an outer surface 1516*a* of the liner fixing groove 1516 expands more in the circumferential direction than the liner fixing portion 173, which has a relatively low thermal strain. Then, a gap may be created between the outer surface 1516*a* of the liner fixing groove 1516 and an outer surface 173*a* of the liner fixing portion 173.

However, the liner fixing jaw 1517 defining the inner surface 1516*b* of the liner fixing groove 1516 thermally expands more than an inner surface 173*b* of the liner fixing portion 173. Then, the line fixing jaw 1517 defining the inner surface 1516*b* of the liner fixing groove 1516 comes into close contact with the inner surface 173*b* of the liner fixing portion 173 and supports the liner 170 by pressing the liner 170 to be open (to be away from the second key groove). This occurs in the opposite liner fixing portion 173 as well. Thus, the liner fixing portions 173 can be open from each other and fixed by both the liner fixing jaws 1517.

On the other hand, during thermal contraction as illustrated in FIG. 18, the opposite phenomenon to the thermal expansion described above may occur and the liner 170 may be fixed. That is, during the thermal contraction of the orbiting scroll 150, the orbiting scroll 150 which has a relatively high thermal strain, is deformed in a direction of being narrower toward the second key groove 1515. At this time, the liner fixing jaw 1517 defining the inner surface 1516*b* of the liner fixing groove 1516 is contracted more in the circumferential direction than the liner fixing portion 173, which has a relatively low thermal strain. Then, a gap may be created between the liner fixing jaw 1517 defining the inner surface of the liner fixing groove 1516 and the inner surface 173*b* of the liner fixing portion 173.

However, the outer surface 1516*a* of the liner fixing groove 1516 undergoes more thermal contraction than the outer surface 173*a* of the liner fixing portion 173. Then, the outer surface 1516*a* of the liner fixing groove 1516 comes into close contact with the outer surface 173*a* of the liner fixing portion 173 and supports the liner 170 by pressing the liner 170 to be narrower (to be close to the second key groove). This occurs in the opposite liner fixing portion 173 as well. Thus, the liner fixing portions 173 can be narrowed (or close) to each other and fixed by both the liner fixing grooves 1516.

In this way, when the liner 170 is inserted into the second key groove 1515, the liner 170 can be stably fixed to the second key groove 1515 without a separate fixing member.

In addition, in this embodiment, the ring body 161 and the key constituting the Oldham ring 160 can be made of a single material, making it easy to manufacture the Oldham ring 160, and the entire Oldham ring 160 can be made of a light material such as aluminum, reducing the weight of the Oldham ring 160, resulting in enhancing motor efficiency.

Meanwhile, in the previous embodiments, the example in which the main frame 130 is made of a different material from the Oldham ring 160 or the orbiting scroll 150 has been representatively described. However, in some cases, the main frame 130 may also be made of the same material as the Oldham ring 160 or the orbiting scroll 150. In this case, the first key 162 of the Oldham ring 160 may be slidably coupled to the main frame 130 in the same manner as the second key 163 described above. The detailed description of this will be replaced by the description of the foregoing embodiment.

Additionally, when the Oldham ring 160 is formed integrally, the liner 170 may be inserted into the first key groove of the main frame 130. The detailed description of this will also be replaced by the description of the foregoing embodiment.

The invention claimed is:

1. A scroll compressor comprising:

an orbiting scroll, as at least one scroll of a plurality of scrolls engaged with each other, coupled to a rotational shaft to perform an orbiting motion; and an Oldham ring slidably coupled to the orbiting scroll to induce the orbiting motion of the orbiting scroll, wherein a key groove is formed in one of the orbiting scroll and the Oldham ring, and a key is disposed on another one to be slidably inserted into the key groove, wherein the key comprises a plurality of fixing protrusions spaced apart from each other, wherein the orbiting scroll or the Oldham ring comprises a plurality of fixing grooves which are spaced apart from each other and in which the plurality of fixing protrusions are fixedly inserted, and wherein the plurality of fixing protrusions are connected into an annular shape and the plurality of fixing grooves are connected into an annular shape.

2. The scroll compressor of claim 1, wherein the Oldham ring comprises a key groove, wherein the plurality of fixing grooves are formed in one side surface of the orbiting scroll facing the key groove, and wherein the plurality of fixing grooves are spaced apart from each other in a circumferential or a radial direction, each of the plurality of fixing grooves being in close contact with at least one of an outer or inner surface of a corresponding one of the plurality of fixing protrusions.

3. The scroll compressor of claim 1, wherein the plurality of fixing protrusions and the plurality of fixing grooves are disposed as pairs and spaced apart from each other along at least one of a circumferential direction and a radial direction.

4. The scroll compressor of claim 1, wherein the plurality of fixing protrusions extend in an axial direction from both circumferential side surfaces of the key.

5. The scroll compressor of claim 1, wherein the key comprises:

circumferential side surfaces disposed at a preset interval on both sides in a circumferential direction; and radial side surfaces disposed at a preset interval on both sides in a radial direction and connecting both the circumferential surfaces to each other, and wherein a hollow portion is defined between inner surfaces of both the circumferential side surfaces and inner surfaces of both the radial side surfaces, and one end portion of each of the circumferential side surfaces and one end portion of each of the radial side surfaces form the plurality of fixing protrusions.

6. The scroll compressor of claim 5, wherein the key further comprises an axial side surface connecting both the circumferential side surfaces and both the radial side surfaces.

7. The scroll compressor of claim 6, wherein the axial side surface has a through hole formed therethrough to have a cross-sectional area smaller than a cross-sectional area of the hollow portion.

8. The scroll compressor of claim 1, wherein the key comprises:

circumferential side surfaces disposed at a preset interval on both sides in a circumferential direction; and a hollow portion defined between both the circumferential side surfaces, and wherein an oil supply groove is formed in an outer surface of at least one of both the circumferential side surfaces or an oil supply hole is formed to penetrate between the outer surface and an inner surface of the at least one circumferential side surface.

9. The scroll compressor of claim 1, wherein the key comprises:

circumferential side surfaces disposed at a preset interval on both sides in a circumferential direction; and a hollow portion defined between both the circumferential side surfaces, and wherein oil supply grooves are formed in circumferential inner surfaces of the key groove facing the circumferential side surfaces.

10. The scroll compressor of claim 1, wherein the Oldham ring is made of the same material as the orbiting scroll.

11. A scroll compressor comprising:

an orbiting scroll, as at least one scroll of a plurality of scrolls engaged with each other, coupled to a rotational shaft to perform an orbiting motion; and an Oldham ring slidably coupled to the orbiting scroll to induce the orbiting motion of the orbiting scroll, wherein a key groove is formed in the orbiting scroll, wherein the Oldham ring comprises:

a ring body formed in an annular shape; and a key extending from the ring body and inserted into the key groove, wherein a liner is inserted into the key groove, wherein a liner fixing groove is formed in one circumferential side or each of both circumferential sides of the key groove to be spaced apart from the key groove, such that at least a portion thereof overlaps the key groove in a circumferential direction, wherein a liner fixing jaw is formed between the key groove and the liner fixing groove, wherein the liner comprises:

a liner body portion inserted into the key groove such that the key is slidably inserted;

a liner extension portion extending in a circumferential direction from the liner body portion; and a liner fixing portion extending axially from the liner extension portion and inserted into the liner fixing groove, and wherein the liner body portion and the liner fixing portion overlap a side surface of the liner fixing jaw in the circumferential direction.

12. The scroll compressor of claim 11, wherein a liner insertion groove is recessed by a preset depth axially into an axial cross-section of the liner fixing groove, such that the liner extension portion is inserted.

13. The scroll compressor of claim 11, wherein an oil supply groove is further formed in an inner surface of the liner body portion to extend in a radial direction.

14. The scroll compressor of claim 11, wherein the ring body and the key are made of the same material, and wherein the liner is made of a different material from the Oldham ring.

* * * * *